US006615559B2

(12) United States Patent
McGrath et al.

(10) Patent No.: US 6,615,559 B2
(45) Date of Patent: Sep. 9, 2003

(54) RESILIENT CONSTRUCTION MEMBER, ESPECIALLY A UNITARY CONSTRUCTION MEMBER

(75) Inventors: Ralph D. McGrath, Granville, OH (US); John C. Chen, Columbus, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/826,131

(22) Filed: Apr. 4, 2001

(65) Prior Publication Data

US 2002/0053180 A1 May 9, 2002

Related U.S. Application Data

(63) Continuation-in-part of application No. 09/430,432, filed on Oct. 29, 1999, which is a continuation-in-part of application No. 09/338,892, filed on Jun. 23, 1999, which is a continuation-in-part of application No. 09/209,308, filed on Dec. 11, 1998.

(51) Int. Cl.[7] ..... E04C 2/34

(52) U.S. Cl. ..... 52/481.1; 52/481.2; 52/690; 52/730.7; 52/731.4; 52/729.1; 52/729.5; 52/290; 52/289

(58) Field of Search ..... 52/690, 730.7, 52/731.4, 729.1, 729.5, 481.1, 481.2, 289, 290

(56) References Cited

U.S. PATENT DOCUMENTS

| | | | |
|---|---|---|---|
| 1,204,956 | A | 11/1916 | Day |
| RE16,183 | E | 10/1925 | Burrell |
| 1,610,578 | A | 12/1926 | Murphy |
| 1,729,741 | A | 10/1929 | Heltzel |
| 1,732,348 | A | 10/1929 | Balduf |
| 1,894,933 | A | 1/1933 | Venzie |
| 1,946,560 | A | 2/1934 | Wick |
| 2,026,117 | A | 12/1935 | Balduf |
| 2,075,772 | A | 3/1937 | Vass |
| 2,081,765 | A | 5/1937 | Prudden |
| 2,187,904 | A | 1/1940 | Hurley |
| 2,565,875 | A | 8/1951 | Musacchia |
| 2,710,335 | A | 6/1955 | Wong |
| 3,046,620 | A | 7/1962 | Tvorik et al. |
| 3,229,435 | A | 1/1966 | Olsen |

(List continued on next page.)

FOREIGN PATENT DOCUMENTS

| | | |
|---|---|---|
| BE | 872 894 A | 4/1979 |
| CA | 1122377 | 4/1982 |
| CH | 552 110 | 7/1974 |
| DE | 1 814 435 | 6/1970 |
| DE | 1 784 729 | 8/1971 |

(List continued on next page.)

*Primary Examiner*—Carl D. Friedman
*Assistant Examiner*—Nahid Amiri
(74) *Attorney, Agent, or Firm*—Inger H. Eckert; Stephen W. Barns

(57) ABSTRACT

A resiliently flexible construction beam includes a pair of lateral flange portions and a web extending therebetween, preferably, but not necessarily, so as to present a cross-sectional profile corresponding to commonly used construction beam members (e.g., 2"×4" or 2"×6"). The resilience of the beam helps to attenuate sound transmission through the beam from one lateral member to the other. In particular, in a wall frame, beams according to the present invention are mounted at opposite ends thereof to end plates. In one example, the end plates include slits into which the webs of the beams can be received. The resilient web according to the present invention is conveniently made from a unitary piece of material such as, for example, steel.

6 Claims, 22 Drawing Sheets

U.S. PATENT DOCUMENTS

| | | | | |
|---|---|---|---|---|
| 3,324,615 | A | | 6/1967 | Zinn |
| 3,349,535 | A | | 10/1967 | Balinski |
| 3,445,975 | A | | 5/1969 | Nelsson |
| 3,609,933 | A | * | 10/1971 | Jahm et al. ..... 52/481.1 |
| 3,712,846 | A | | 1/1973 | Daniels et al. |
| 3,721,050 | A | | 3/1973 | Perina |
| 3,950,912 | A | | 4/1976 | Lundberg et al. |
| 3,999,343 | A | | 12/1976 | Roberts |
| 4,207,719 | A | | 6/1980 | Knowles |
| 4,317,503 | A | | 3/1982 | Soderquist et al. |
| 4,337,287 | A | | 6/1982 | Falkenberg |
| 4,364,212 | A | | 12/1982 | Pearson et al. |
| 4,466,225 | A | | 8/1984 | Hovind |
| 4,661,392 | A | | 4/1987 | Kapstad |
| 4,794,746 | A | | 1/1989 | Ramer |
| 5,079,894 | A | | 1/1992 | Lau |
| 5,117,598 | A | | 6/1992 | Livingston et al. |
| 5,146,721 | A | | 9/1992 | Candiracci |
| 5,157,883 | A | | 10/1992 | Meyer |
| 5,272,284 | A | | 12/1993 | Schmanski |
| 5,301,487 | A | | 4/1994 | Wiebe |
| 5,502,931 | A | | 4/1996 | Munir |
| 5,511,355 | A | * | 4/1996 | Singler ..... 52/729.5 |
| 5,605,024 | A | | 2/1997 | Sucato et al. |
| 5,606,833 | A | | 3/1997 | Anderson |
| 5,606,841 | A | | 3/1997 | Carter, Jr. |
| 5,743,058 | A | | 4/1998 | Boomsma |
| 5,852,908 | A | | 12/1998 | Nankin |
| 5,923,002 | A | | 7/1999 | McGrath et al. |
| 6,007,890 | A | | 12/1999 | DeBlander |

FOREIGN PATENT DOCUMENTS

| | | | |
|---|---|---|---|
| EP | 0 136 618 | A | 4/1985 |
| EP | 0 249 085 | | 12/1987 |
| EP | 0 745 470 | A | 12/1996 |
| FR | 2 221 604 | A | 10/1974 |
| FR | 2 541 707 | | 8/1984 |
| FR | 2575243 | | 6/1986 |
| GB | 630 311 | A | 10/1949 |
| WO | WO 91 02865 | A | 3/1991 |

* cited by examiner

RESILIENT CONSTRUCTION MEMBER, ESPECIALLY A UNITARY CONSTRUCTION MEMBER

This application is a continuation-in-part of U.S. application Ser. No. 09/430,432 entitled "Resilient Construction Member and Retrofit System Using Same" (filed on Oct. 29, 1999 and still pending), the entire contents of which is incorporated herein by reference. U.S. application Ser. No. 09/430,432 is in turn a continuation-in-part of U.S. application Ser. No. 09/338,892 entitled "Self-Jigging Resilient Construction Member and Retrofit System Using Same" (filed on Jun. 23, 1999 and still pending), the entire contents of which is incorporated herein by reference. U.S. application Ser. No. 09/338,892 is in turn a continuation-in-part of U.S. application Ser. No. 09/209,308 entitled "Resilient Wall Stud" (filed on Dec. 11, 1998 and still pending), that entire application being also incorporated herein by reference.

TECHNICAL FIELD AND INDUSTRIAL APPLICABILITY OF THE INVENTION

The present invention relates to members used in construction, especially in applications where sound attenuation and sound isolation is important. In particular, the present invention relates to construction members used to construct building structures in which sound transmission from one room to another is to be prevented or reduced. In particular, the present invention relates to construction members having a unitary, or "one-piece" form, especially those made from metallic materials including, but not limited to, steel.

BACKGROUND OF THE INVENTION

Standard wall frame systems including a plurality of interconnected individual studs have long been used to construct walls. Also, in general, it is conventionally known to resiliently mount a wall or ceiling in order to isolate sound or attenuate transmission therethrough.

U.S. Pat. No. 3,445,975 to Nelsson discloses a partition in which first and second lath panels are held against a metallic stud, channel, or furring member by a clip fastener. One portion of the stud, channel, or furring member is cantilevered away from the portion at which the lath panels are clipped thereto. According to Nelsson, this permits the free portion of the stud, channel, or furring member to flex as the lath panels mechanically respond to sound waves incident thereon. The remainder of the structure dampens this surface movement, reducing sound transmission to the opposite surface of the partition.

U.S. Pat. No. 3,324,615 to Zinn discloses a construction member having a plurality of laterally extending supporting tabs by which wallboard segments are resiliently mounted.

U.S. Pat. No. 3,046,620 to Tvorik et al. discloses a ceiling hanger member whereby a furring strip (to which a ceiling member is attached) is resiliently attached to a joist, such that the weight of the furring strip and ceiling member resiliently separates the furring strip from the joist.

Another known method of sound attenuation is to build a wall frame in which individual studs are laterally staggered relative to a toe plate and head plate. Therefore, alternate studs are used to mount wall board on respective sides of the frame so that a given stud is spaced away from one of wall boards.

Unfortunately, the foregoing conventional methods of noise attenuation are problematic in that they generally move away from basic construction methods and thereby increase complexity and cost. For example, they require additional parts (such as Tvorik et al. and Nelsson) or specially made parts (such as the channel member with specially formed support tabs, as in Zinn). The staggered stud arrangement necessarily results in a thicker wall partition which reduces the area of the room whose walls are framed in this manner, and increases the cost of the toe and head plates.

In addition, nail fasteners generally cannot be used with metal members, thereby undesirably restricting available construction methods.

Finally, a standard wall frame system must generally be completely torn down to put a conventional sound attenuating systems into place. It would be therefore desirable to be able to retrofit a standard wall frame system so as to increase its sound attenuation characteristics.

In addition to the devices for sound attenuation described hereinabove, a wood I-beam is commercially available (e.g., under the brand name "BCI Advantage" from Boise Cascade Corporation) that comprises a pair of wood members with a rigid wooden panel extending therebetween. However, because the wooden panel is essentially non-resilient, this I-beam offers little or no sound attenuation benefit.

Commonly owned U.S. patent application Ser. No. 09/209,308 is directed to a resilient construction member comprising a pair of spaced apart lateral members and a resilient web extending between the lateral members. A frame system using such members is also disclosed. The resilience provided by the resilient web advantageously attenuates sound transmission across the construction beam member.

Commonly owned U.S. patent application Ser. No. 09/338,892 is directed to a construction beam member of the type generally disclosed in application Ser. No. 09/209,308, but in which one or more resilient webs are provided with one or more spacer structures. In this manner, the respective lateral members are easily oriented relative to the web, in a manner generally known in the construction art as "self-jigging." This configuration is particularly suitable for retrofitting a preexisting frame structure (made from single studs) so as to create, after the fact, a frame comprising resilient construction members according to the, present invention. The application discloses providing a single lateral member having one or more resilient webs thereon. The one or more resilient webs include spacer structures so as to facilitate orientation of the lateral member/web(s) relative to a preexisting stud.

SUMMARY OF THE INVENTION

The present invention is therefore most generally directed to a construction member that relies on resilient flexibility in order to attenuate sound transmission therethrough, but also more closely conforms to conventional building members in order to minimize or eliminate the need for any special handling or the like in use.

In particular, the present invention is directed to a construction beam member which are comparable in size to conventional wood beams (e.g., 2"×4" or 2"×6"). The beam comprises a pair of spaced lateral members having at least one resilient web extending therebetween. The web is preferably relatively stiff, but permits a slight flexure between the lateral members. The lateral members are preferably, but not necessarily, made from an easily workable material such as wood.

In addition, the web is preferably, but not necessarily, provided with one or more spacers so as to facilitate the arrangement of the respective lateral members relative to each other and relative to the web. In part, this facilitates the assembly of the lateral members relative to each other and relative to the lateral web so as to obtain a beam member according to the present invention:

In a particular embodiment of the present invention, a retrofit system comprising one lateral member having a resilient web attached thereto is provided. The resilient web is provided with one or more spacers so that the one lateral member having the resilient web attached thereto can be easily positioned relative to a respective beam in a standard wall frame construction, thereby imparting the sound attenuation benefits of a frame using resilient construction beams without needing to completely tear down the original structure. In this arrangement, respective beams in the standard wall frame act as the other lateral member of the beam according to the present invention.

In one embodiment of the present invention, in accordance with the foregoing, the resilient web is made from a unitary piece of material. In one form, the beam has an x-shaped cross-section. The respective ends of the "x" are attached to the respective lateral members in a known manner. Furthermore, the resilient web formed in this manner may include spacers, as discussed above, to facilitate orientation of the respective lateral members relative to the resilient web. Moreover, the x-shaped resilient web may be used in combination with one lateral member, such that the other side of the resilient web may be used to retrofit a beam in a standard wall frame construction, as discussed above.

In yet another embodiment, the construction beam member according to the present invention is made from a single piece of resiliently rigid material, such as bent steel. The beam member includes at least one flange member (usually two), and a web extending therefrom. The beam member according to this embodiment of the present invention (especially when a metal material is used) is particularly suitable for applications when conventional C-shaped steel studs are to be replaced so as to provide greater sound attenuation benefit.

BRIEF DESCRIPTION OF THE DRAWINGS

The present invention will be described in detail hereinbelow, with reference to the drawings appended hereto, in which.

DETAILED DESCRIPTION AND PREFERRED EMBODIMENTS OF THE PRESENT INVENTION

Figure 1:
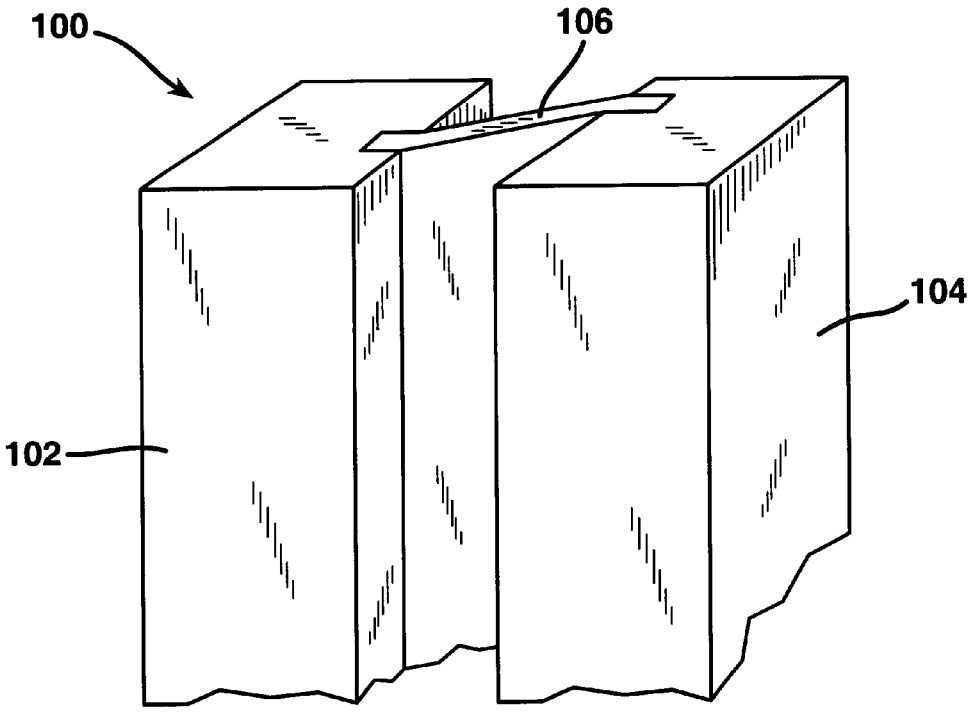
FIG. 1 is a partial perspective view of an end of a construction beam according to the present invention.
Figure 2:
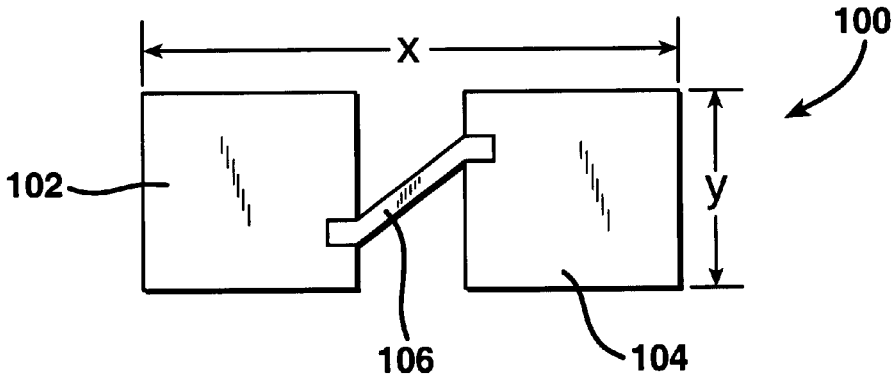
FIG. 2 is an end view of a beam according to the present invention.

FIGS. 1 and 2 illustrate a portion of a beam 100 according to the present invention. In general, beam 100 comprises lateral members 102 and 104 with a web 106 spanning therebetween.

Lateral members 102, 104 are generally (but not always, as discussed below) rectangular or squared in cross-sectional profile and preferably have at least the same thickness y (see FIG. 2). Moreover, lateral beams 102, 104 are preferably identical so that each has the same width, proportionately spaced with web 106 therebetween so as to present an overall beam width x. Lateral members 102, 104 are preferably (but not necessarily) identical in shape so as to facilitate manufacture of beam 100 from one source of stock.

Accordingly, beam 100 can present a cross section having a major dimension x and minor dimension y corresponding to any standard beam size (e.g., 2"×4", 2"×6", and so on, without limitation).

According to the present invention, lateral members 102, 104 are elongate rigid members. Accordingly, a variety of suitably rigid materials could be used. However, lateral members 102, 104 are preferably (but not exclusively) made from wood, (in part, in keeping with an intent of the present invention to present a construction member very similar to those conventionally used in the art). Wood is also desirable because it can be worked, generally, in more ways than comparable metal members (e.g., it can be easily cut, driven with nails or screws, etc.). Not only can continuous lumber be used, but composite materials, such as plywood or wood particle board can be used. In addition, finger jointed wood members can be used according to the. present invention. A plastic material reinforced with glass fibers may also be used in accordance with the present invention.

Web 106 is made from a relatively rigid material that has some flexibility. If web 106 is relatively too flexible, lateral members 102, 104 have too much relative freedom of movement and beam 100 is no longer, overall, a rigid member. If web 106 is relatively too stiff, then the benefits of sound isolation/attenuation are lost. Generally, web 106 may be made from any suitably stiff and resilient material, including (without limitation) rubber, asphalt, plastic or other resilient polymeric material.

Figure 4:
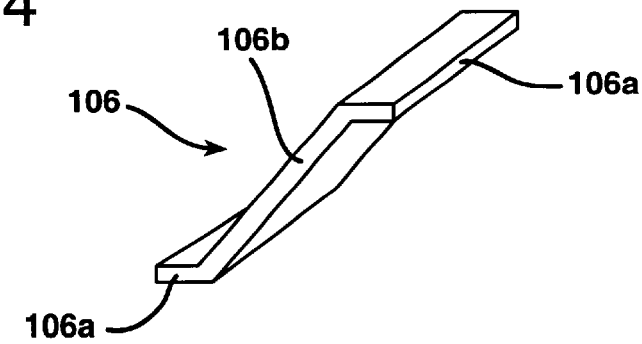
FIG. 4 is a perspective view of an example of a resilient web for linking lateral members in a beam according to the present invention.

In one example of the present invention, web 106 is made from galvanized 22 gauge steel. As seen in FIG. 4, web 106 includes edge portions 106*a* and an intermediate portion 106*b*. Edge portions 106*a* are embedded in lateral members 102, 104, and intermediate portion 106*b* extends obliquely between lateral members 102, 104. However, intermediate portion 106*b* may, most generally, extend between lateral members 102, 104 in any orientation so long as flexure between lateral members 102, 104 is relatively easy (compared to, for example, an intermediate portion extending straight across the gap between lateral members 102, 104, which does not readily flex). The use of galvanized steel as described here may offer additional ancillary benefits, such as improved fire safety protection.

Edge portions 106*a* are embedded in lateral members 102, 104 in any conventional manner. One possible method (not illustrated) is to form grooves in lateral members 102, 104 that are wider than the thickness of edge portions 106*a*. Once edge portions 106*a* are suitably disposed in the respective grooves, additional strips of material (such as wood) are pressed into the remaining space in the grooves, such that edge portions 106*a* are wedged into place and retained in the grooves.

Web 106 may extend continuously substantially the entire length of lateral members 102, 104. However, when beams 100 are used in construction, it is useful to provide a plurality of spaced apart webs 106, such that piping, wiring and the like can be passed through the openings between webs 106 (see FIG. 3).

Figure 3:
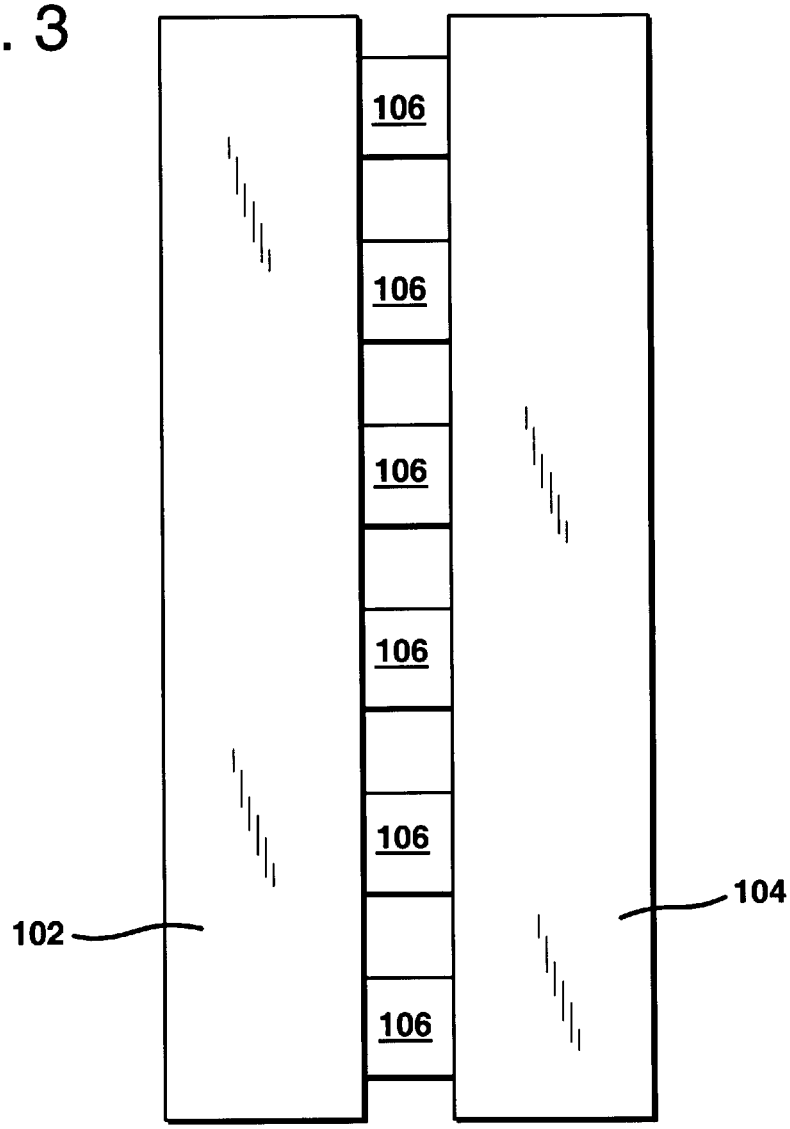
FIG. 3 is a plan view of a beam according to a second embodiment of the present invention.

Whether one or a plurality of webs 106 are provided, it is specifically contemplated that beams 100 are provided in standardized lengths (e.g., 8') as seen in FIG. 3 and can be cut down as required.

As mentioned above, it is an important feature of the present invention to provide a construction member that can be used like conventional construction beams. Accordingly, FIG. 5 is a partial perspective view of a frame work (as might be used for walls in a building).

Figure 5:
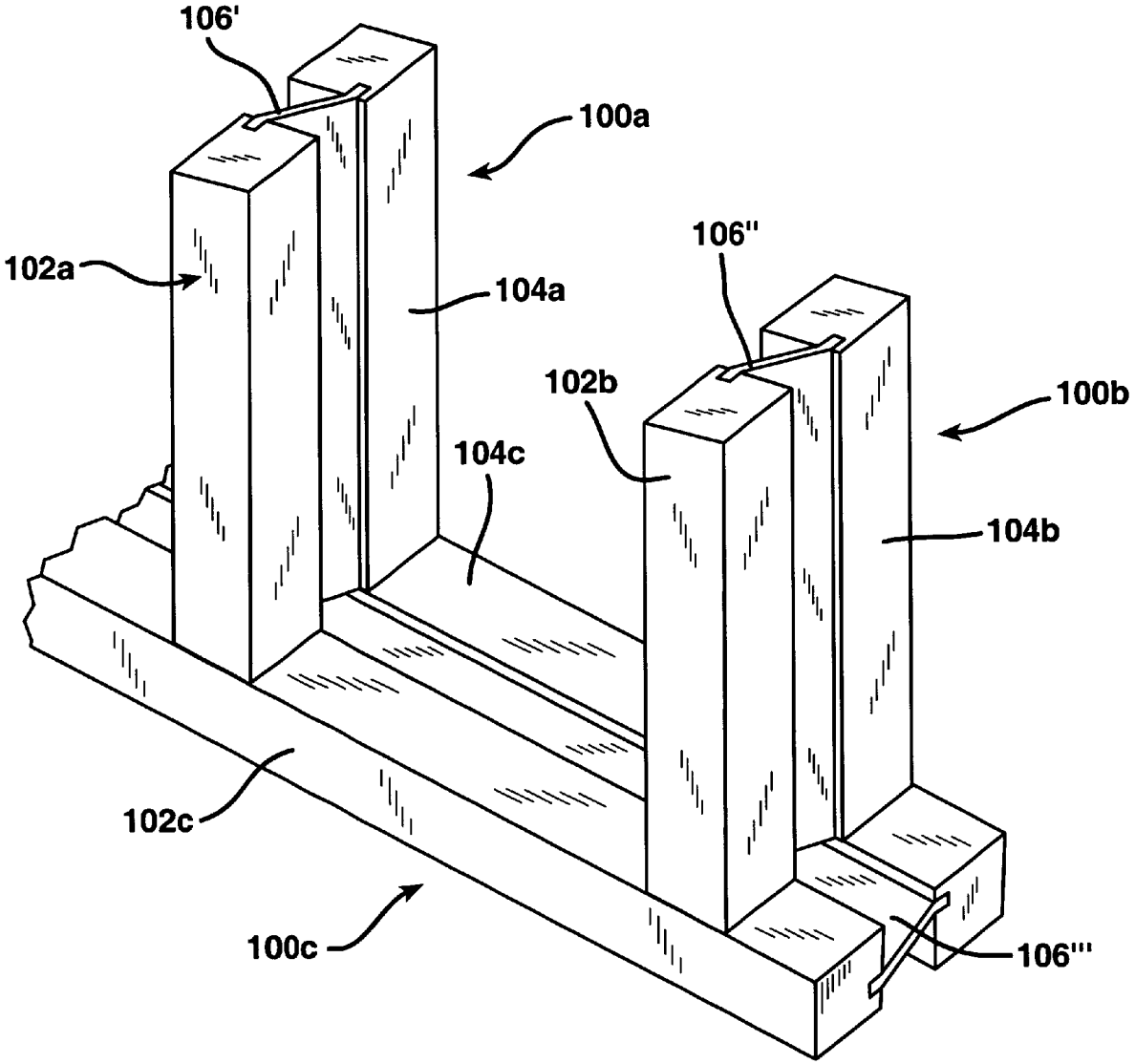
FIG. 5 is a partial perspective view of a framework for mounting wallboard or the like, utilizing beams according to the present invention.

As seen in FIG. 5, beams 100*a*, 100*b* are mounted as studs on a laterally extending beam (i.e., a head plate or toe plate) 100*c*. (Another laterally extending beam (not shown) is provided at the other end of beams 100*a*, 100*b*.) The structure of each of beams 100*a*–100*c* is in accordance with the description of the present invention hereinabove, and will not be repeated here. Attention is drawn to the manner in which lateral members 102*a* and 102*b* and 104*a* and 104*b* are mounted with respect to lateral members 102*c* and 104*c*, respectively, with nails, screws or any other conventional fasteners (not shown here). Accordingly, it can be appreciated that one side of the frame (i.e., lateral members 102*a*–102*c*) is resiliently separated by way of respective webs 106', 106", and 106'" from the other side of the frame (i.e., lateral members 104*a*–104*c*). Accordingly, sound impinging on a wall member mounted on one side of the frame is attenuated upon transmission to the other side of the frame because of the resilience of webs 106', 106", and 106'".

Furthermore, it is possible to resiliently mount a wall so that it acts like a diaphragmatic sound absorber. In particular, only one "side" of the frame assembly (e.g., lateral member 104*c* and/or lateral members 104*a*, 104*b*) is fixed to the surrounding building structure, and the other side of the frame assembly has wall board or the like mounted thereon (i.e., on lateral members 102*a*, 102*b*), without attachment to the surrounding structure. The wall is therefore mounted on the "free" or "floating" side of the studs.

A particularly beneficial wall board structure is disclosed in commonly owned and co-pending application Ser. No. 09/260,272, and comprises, generally, first and second dry wall layers with a visco-elastic material layer interposed therebetween. In particular, a visco-elastic asphalt material is useful with such a wall board structure.

In order to enhance the effect of decoupling the one side of the wall frame from the surrounding structure, it is desirable to provide a soft gasket (made from, for example, foam rubber) between the lateral beam 100*c* and the surrounding structure (i.e., the ceiling and/or floor). This promotes relatively free movement of the one side of the frame that is not fixed to the surrounding building structure.

To further enhance the effect of decoupling the wall from the surrounding structure, it is preferable to provide flexible joint material at junctions between wall board segments (not illustrated here), including at corners of rooms. Therefore the wall surface is visually continuous, but physically decoupled, in order to take advantage of the resultant sound attenuation effects.

Also, it is very desirable to provide additional sound and/or thermal insulation in the spaces defined by the studs and end plates. Such insulation can be of any conventional type, including blown, rolled or batting, foam board, etc. The addition of such insulation enhances sound attenuation effects resulting from the present invention.

Figure 6:
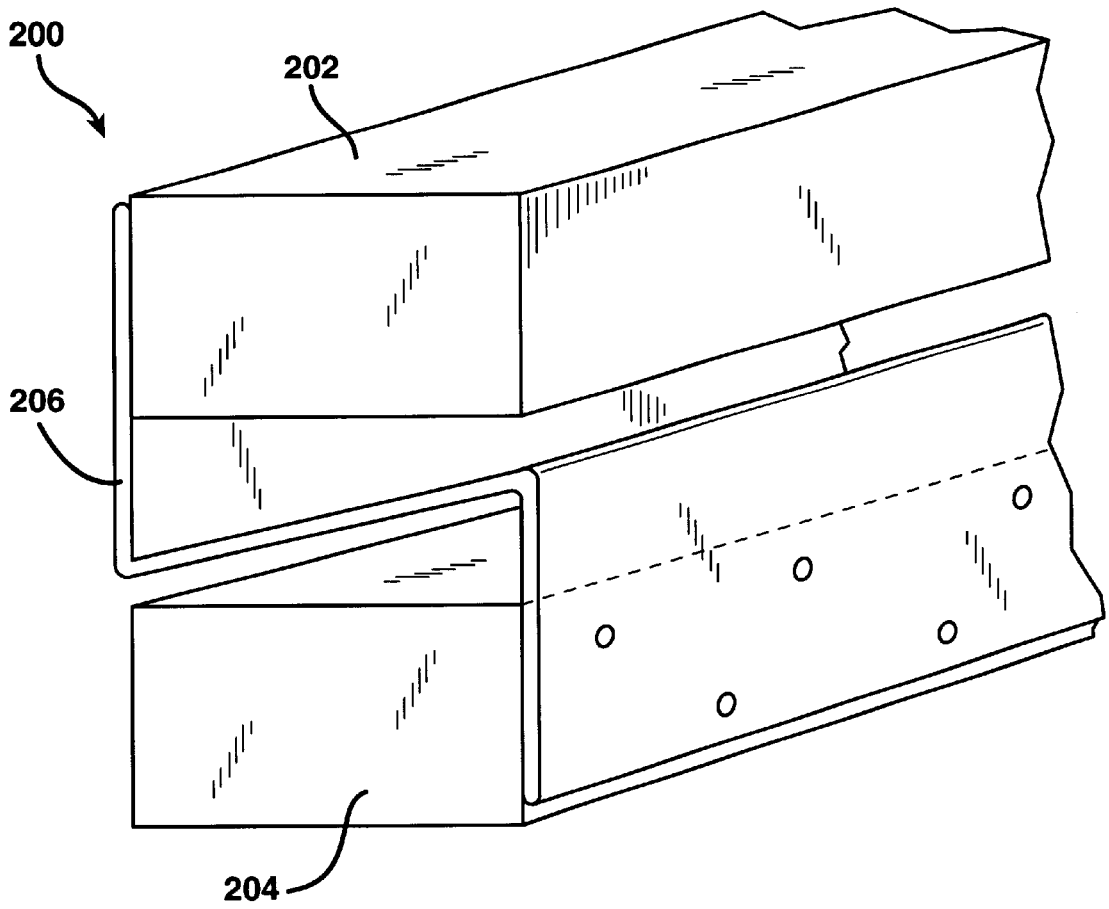
FIG. 6 is a partial perspective view of a beam according to a third embodiment of the present invention.
Figure 7:
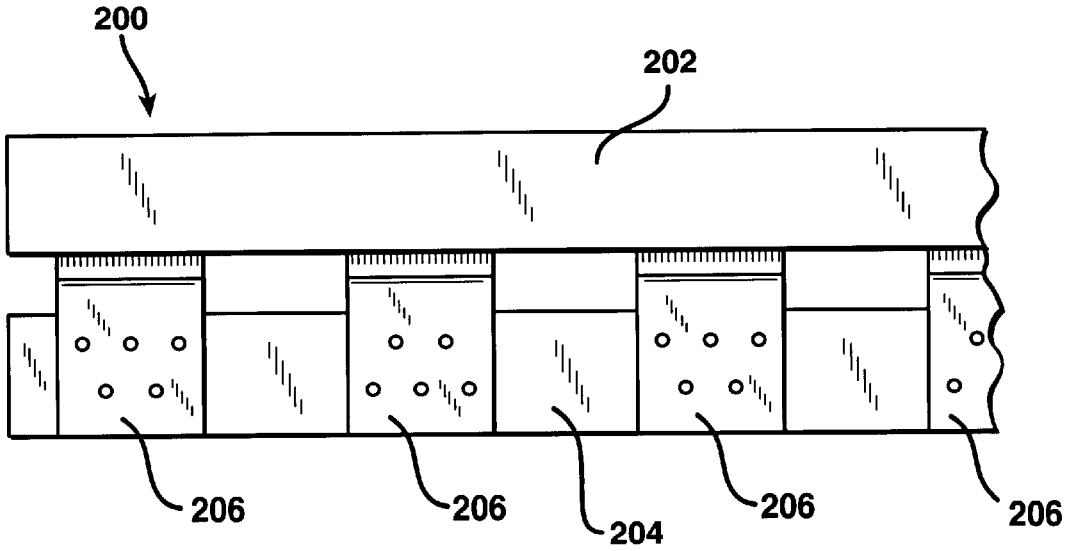
FIG. 7 is a plan view of a beam according to the embodiment of the present invention shown in FIG. 6.

FIGS. 6 and 7 are a partial perspective view and a partial plan view, respectively, of beam 200, in accordance with another embodiment of the present invention.

The design concept underlying beam 200 is fundamentally similar to that of beam 100. Like before, lateral members 202 and 204 are provided, and are resiliently spaced apart from each other by web 206. Unlike web 106 in beam 100, however, web 206 is not embedded in lateral members 202, 204. Instead, web 206 is fixed (by any conventional means, such as nails 205, as shown in FIGS. 6 and 7) relative to opposite faces of lateral members 202, 204 along the major dimension of the beam cross section.

As in the first embodiment, a plurality of spaced apart webs 206 may be provided along the length of beam 200 (see, for example, FIG. 7).

Web 206 is preferably made from a material that is slightly more flexible than that used for web 106, such as 24 gauge galvanized steel.

Initial comparative testing has been undertaken comparing the sound attenuation characteristics of conventional construction members versus beam 100 and beam 200, respectively. Initial results indicate that beam 100 has greater than expected attenuation characteristics, and that beam 200 should have even better attenuation performance than beam 100. This latter effect is thought to be caused by the shape and orientation of web 206, which more easily permits a normal compression between lateral members 202, 204.

Figure 8:
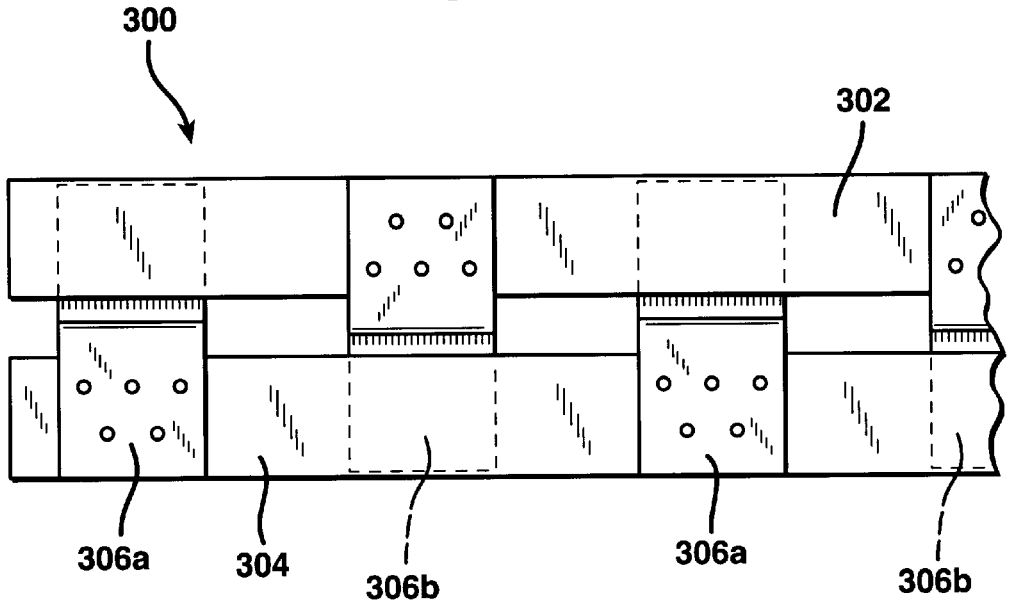
FIG. 8 is a plan view of a variant of the beam shown in FIG. 7.

In addition, as a variation of the embodiment illustrated in FIG. 7, the plurality of webs are alternately arranged so that the portion of the webs extending obliquely thereacross alternates (thereby crossing each other, as seen from an end of beam 200) (see FIG. 8). In FIG. 8, beam 300 comprises lateral beams 302 and 304, and includes a plurality of first webs 306*a* which are spaced from and alternate with a plurality of second webs 306*b*. Accordingly, respective intermediate portions of webs 306*a* and 306*b* criss-cross as seen from an end of beam 300.

Inasmuch as sound that one seeks to attenuate or isolate is typically physically unique relative to particular environments (e.g., a home theater room, a movie theater, a machine shop, a recording studio, a concert hall), it is an important feature of the present invention to provide a construction member that can be "tuned" in order to tailor its sound attenuation properties for a specific environment. In other words, a beam according to the present invention can be specifically manufactured so that its resilient properties (in terms of, for example, spring constant) are made to correspond to a particular kind of sound (especially in terms of its frequency) so that sound attenuation can be maximized.

Such "tuning" can be accomplished by varying the thickness of web 106, 206, either -uniformly or variably over the entire area of web 106, 206. In addition, notches, slits, or other openings can be formed in web 106, 206 to control the resilience of web 106, 206 in accordance with known principles of physics. In addition, suitably sized perforations or openings in a continuous web can be formed so as to create a tunable Helmholtz resonator effect between adjacent cavities defined between studs in the framework illustrated in FIG. 5. By altering the number and/or size of the perforations or openings, a resultant Helmholtz resonant frequency can be controlled, at which attenuation of sound at that frequency is maximized. It should be noted that this is different from reference to a plurality of webs as shown in FIGS. 3, 7, and 8.

It can therefore be appreciated that adjoining rooms may be constructed (e.g., adjoining musical studios) such that each room can be tuned in accordance with its respective mode of use. In particular, this may be accomplished by constructed "double wall" framework, where two frames of the structure illustrated in FIG. 5 are constructed face-to-face, such that the respective opposing sides of the frames are fixed to the surrounding building structure and their respective opposite sides are left free floating in the manner discussed above.

Assembly of lateral members and resilient webs according to the present invention is facilitated by providing at least one spacer on the resilient web or webs to orient the lateral members relative to the resilient web.

Figure 10:
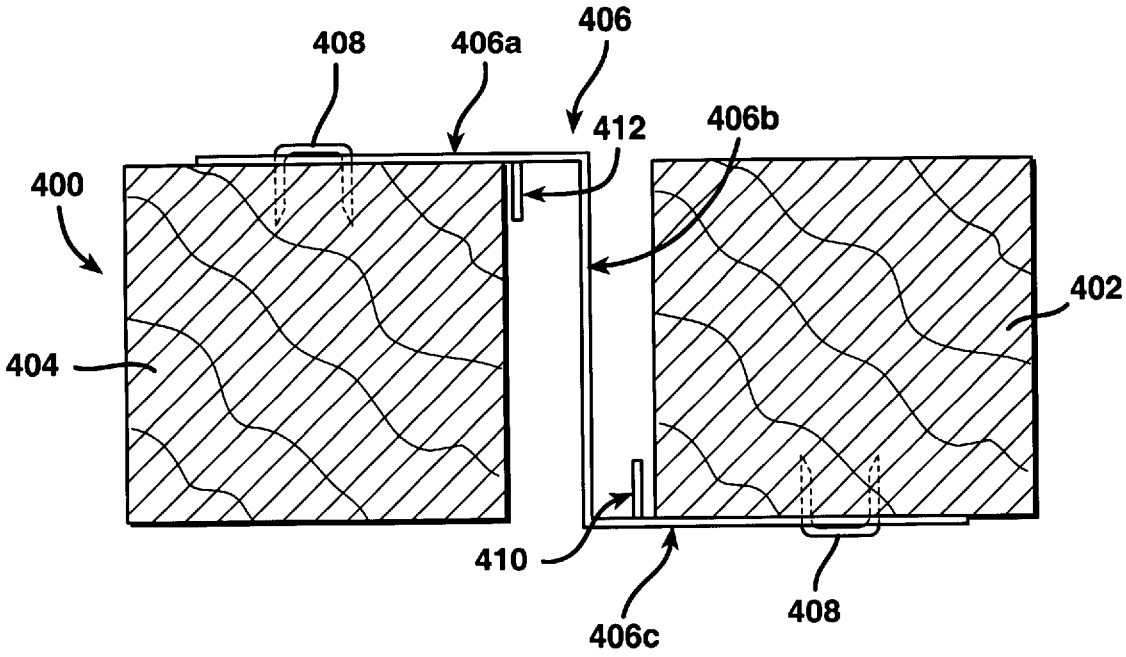
FIG. 10 is a cross-sectional view of a construction member according to a fifth embodiment of the present invention shown in FIG. 9.

FIG. 10 is a schematic cross-sectional view of a beam 400, somewhat similar to beams 200 and 300 in FIGS. 6–8. Here again, beam 400 comprises lateral members 402 and 404, and a resilient web 406 extending therebetween.

Resilient web 406 is attached to opposite facing sides of lateral members 402 and 404, respectively, by, for example, staples 408 (although any conventional attachment method can be used, including, without limitation, screws, nails, bolts, and the like).

Resilient web includes a first portion 406*a,* a second portion 406*b* bent at an angle to first portion 406*a,* and a third portion 406*c* bent at an angle to second portion 406*b* and generally parallel with first portion 406*a*. Generally, lateral members 402 and 404 are received in the bends defined by the first and second portions 406*a* and 406*b,* and by the second and third portions 406*b* and 406*c,* as shown in FIG. 10.

It is a particular feature of this embodiment to provide a spacer 410 (412) on at least one of first and third portions 406*a* and 406*c* to space a respective at least one of the lateral members 402 and 404 away from second portion 406*b* of the resilient web 406. In general, the provision of spacers 410 (412) allows easy assembly of the lateral members and the resilient web (known in the art as "self-jigging"). In particular, the provision of spacers 410, 412 prevents the respective lateral members 402, 404 from being placed in abutting relation to second portion 406*b*. If such an arrangement were to be had, then the abutment of the resilient members against the second portion 406*b* would undesirably retard the resilient sound-damping characteristics of the resilient web 406.

It is noted that the slight spacing shown in FIG. 10 between lateral members 402 and 404 and the resilient web 406 is for clarity of illustration only and is not necessarily illustrative of the present invention.

The arrangement of the present invention illustrated in FIG. 10 can be extended desirably to an apparatus and method for retrofitting standard beam members, especially beam members already assembled into a standard frame arrangement.

Figure 9:
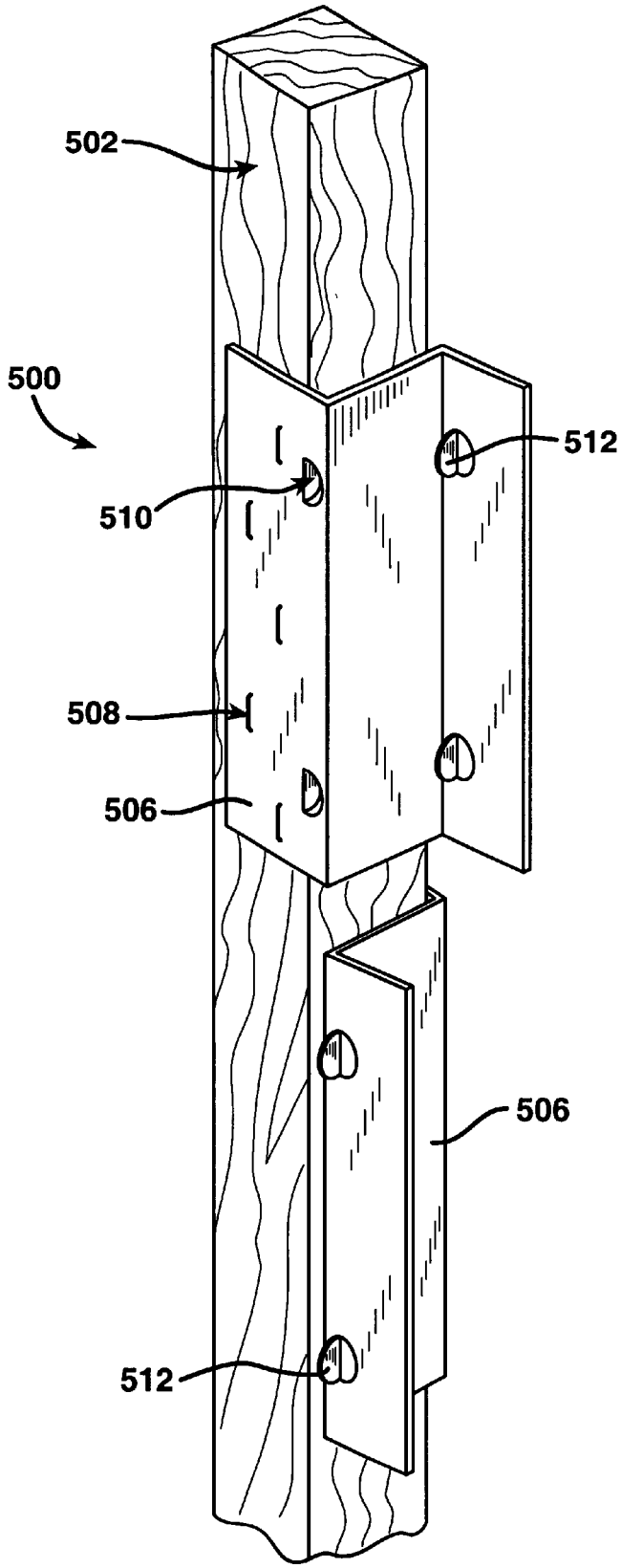
FIG. 9 is a perspective view of a retrofit assembly including a lateral member and a web, according to a fourth embodiment of the present invention.

FIG. 9 illustrates a retrofitting assembly 500 comprising a lateral beam 502, to which at least one resilient web 506 is attached by staples 508 or the like. Each resilient web 506 as shown includes spacers 510 and 512. However, the provision of spacers 512 is most important here. It is emphasized that assembly 500 in and of itself is not a construction member per se, but is used in conjunction with standard beams in order to provide a resilient beam arrangement.

As before, resilient web 506 may be made from any suitably resilient material, including (without limitation) metal, rubber, asphalt, plastic, or other resilient polymeric material. In one example, spacers 510, 512 are protruding tabs formed integrally with the resilient web 506. In a specific example, spacers 510, 512 may be punch-formed into the material of the resilient web 506 (especially, but not necessarily only, where the resilient web 506 is made from metal). The punch-formed portions can simply be turned away from the web material as needed to form the required spacers.

In the arrangement illustrated in FIG. 9, it is especially important to provide spacers 512 as shown. The assembly 500 is arranged relative to a single standard beam such as a 2"×4" (not shown here) and fastened thereto (again, by staples, screws, nails, bolts, or any known and suitable fastener). The arrangement of the assembly 500 relative to a standard beam is made simple by the provision of spacers 512, especially where assembly 500 is coupled to a standard beam forming part of a conventional framework.

In addition, the resilient webs 506 may be provided in an alternating arrangement, so that opposite sides of lateral member 502 are attached to respective resilient webs 506, as seen in FIG. 9 (this is similar to the arrangement illustrated in FIG. 8 and discussed above). With this arrangement, the assembly 500 may be even more easily arranged relative to a standard beam by orienting the assembly 500 so that respective free ends of the resilient webs 506 are arranged on opposite sides of the standard beam. Although the alternating arrangement of resilient webs 506 seen in FIG. 9 is beneficial (for reasons similar to those discussed above relative to FIG. 8), it is not necessary according to the present invention. The present invention is certainly operable with the resilient webs 506 all arranged in like manner along lateral member 502.

As with the other embodiments discussed above, lateral member 502 may be rectangular or squared in cross-section, and may preferably be made from continuous lumber or a composite wood material, as well as plastic reinforced with glass fibers.

In one example of the present invention, the spacers 410, 412, 510, 512 may be arranged to space the respective lateral members about 0.25 inches from the portion of the resilient web spanning the space between the lateral members. However, the present invention is not restricted to a specific spacing, except for that sufficient to prevent the respective lateral members from fully abutting the resilient web, as discussed above.

One of ordinary skill will appreciate that the resilient web 506 may be shaped so as to be attached to lateral members of different profiles. In one example, a lateral member 502 which is rectangular or squared in cross-section attached to the resilient web 506 may be used so as to be attached to a conventional rigid I-beam (discussed above relative to the related art) or vice versa.

It will be appreciated that the assembly 500 as seen in FIG. 9 can been seen as somewhat analogous to a conventional resilient channel. However, at least because of the self-jigging aspect of the assembly 500 (due to the provision of spacers), the assembly 500 is much easier to work with compared with resilient channel structures.

Figure 11:
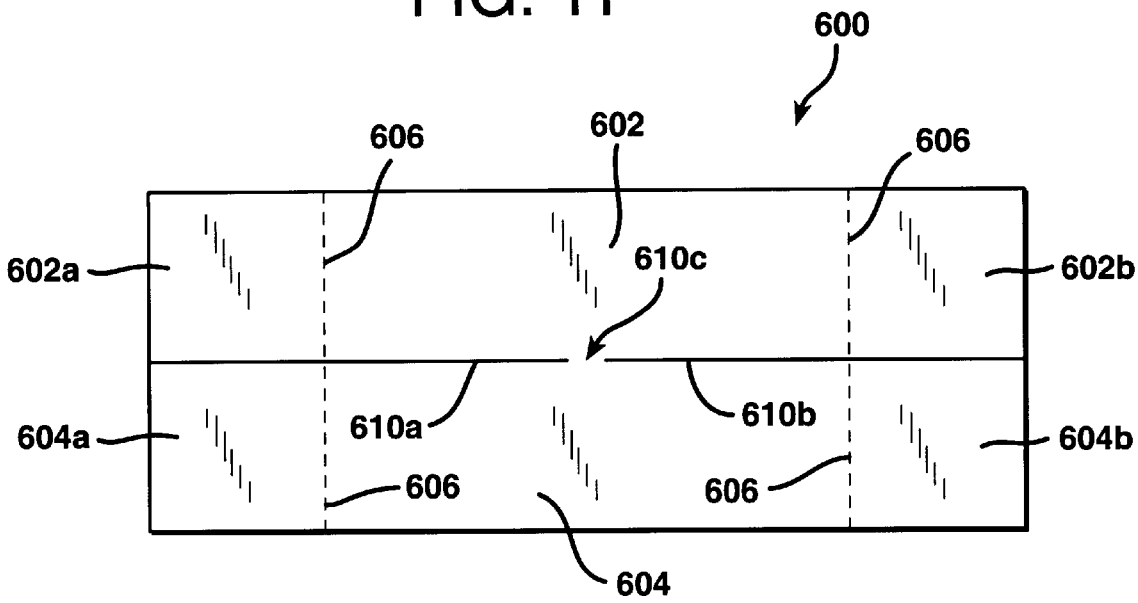
FIG. 11 is a plan view of a resilient web according to a sixth embodiment of,the present invention.
Figure 12:
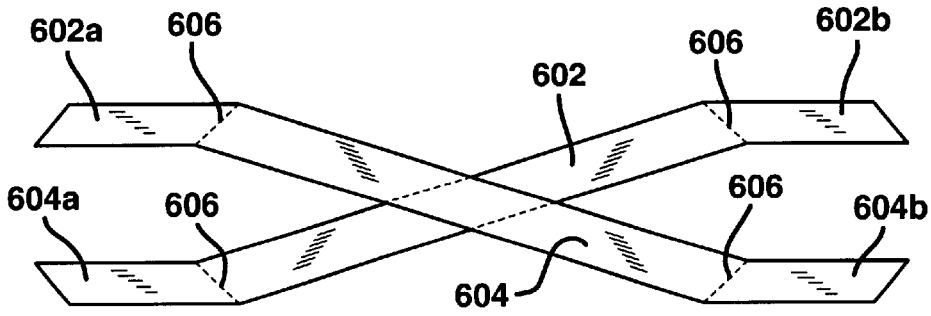
FIG. 12 is a front perspective view of the resilient web illustrated in FIG. 11.
Figure 13:
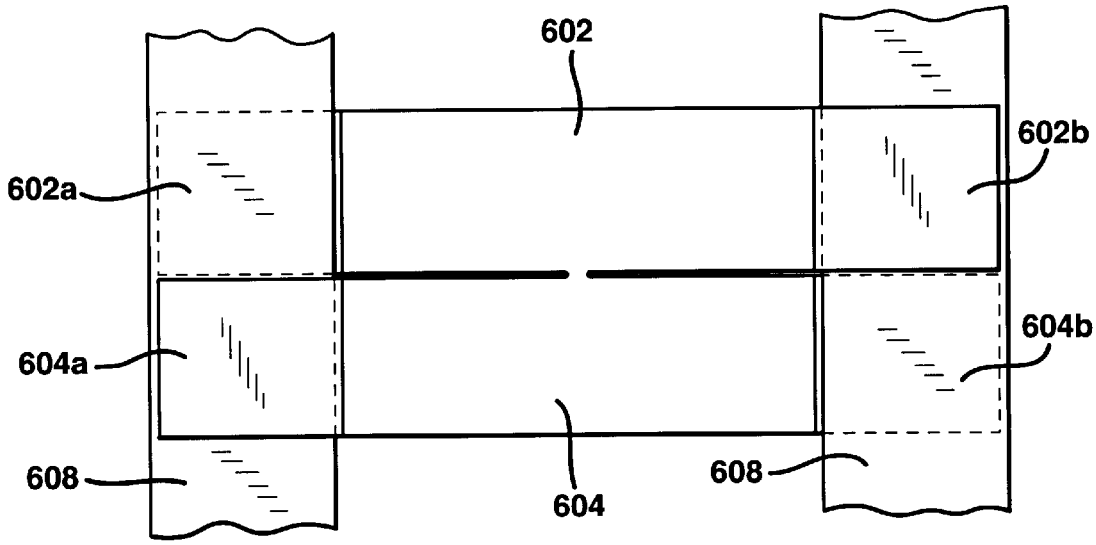
FIG. 13 is a front elevational view of a resilient construction member according to the sixth embodiment of the present invention.
Figure 14:
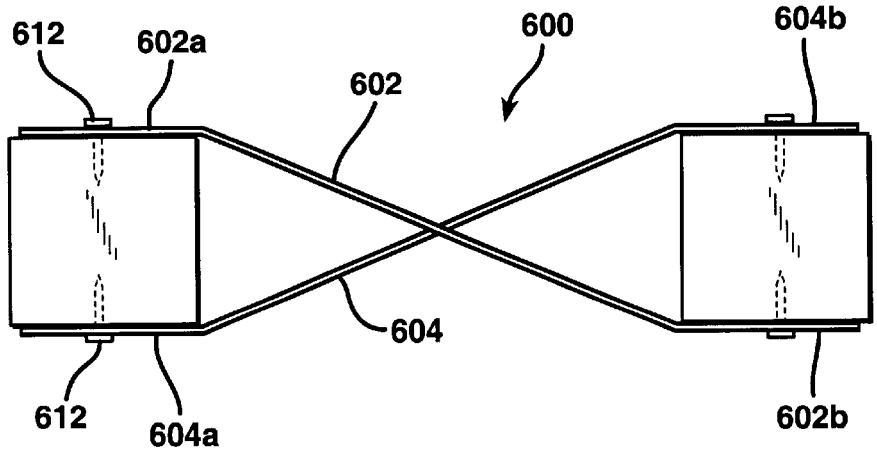
FIG. 14 is an end view of a resilient construction member according to the sixth embodiment of the present invention.

FIG. 11 is a plan view of a resilient web 600 according to sixth embodiment of the present invention. Resilient web 600 is characteristically made from a single piece of material formed so as to generally have a x-shape in cross-section. In general, resilient web includes first and second main portions 602, 604 which are angled relative to one another (see, for example, FIG. 12). Each main portion 602, 604 has first and second end portions (602*a*, 602*b*, 604*a*, 604*b*) adapted to be attached to lateral members 608 (see, for example, FIGS. 13 and 14) so as to form a construction member according to the present invention. For example, the first and second end portions of each main portion may be bent relative to their respective main portions at fold; lines 606, whereby the lateral members 608 are arranged between generally parallel but unaligned first portions 602*a*, 604*a* and second portions 602*b*, 604*b* (see, again, for example, FIGS. 13 and 14).

Resilient web 600 may, for example, be made from a flat piece of metal (for example, steel). Longitudinal cuts 610*a* and 610*b* are formed generally down the midwidth of the piece of metal, all the way to the respective longitudinal ends of the piece of metal. Longitudinal cuts 610*a* and 610*b* may or may not be aligned with each other. Furthermnore, longitudinal cuts 610*a* and 610*b* do not meet (lest the piece of metal be completely severed), but end at a pivot point or line 610*c*. In forming the resilient web, first and second main portions 602 and 604 are rotated relative to each other about a pivot axis lying in the plane of the originally flat piece of metal and extending through the pivot point 610*c*. Although steel was specified above as a material of manufacture, any suitable metallic material may be used instead. Indeed, any (metallic or non-metallic) material that is similar in bending stiffness to steel may be used, as long as its physical characteristics are amenable as a whole to the invention disclosed herein (especially with regard to resilient flexibility). In addition, the first and second end portions of each main portion 602, 604 may be bent as needed so as to be attachable to lateral members 608. As seen, by way of example in FIG. 14, the respective end portions are attached to lateral members 608 conventional fasteners such as nails 612, but alternatively including, without limitation, screws, rivets, staples, liquid or solid adhesive, or any combination of one or more conventional fasteners.

Instead of cutting and bendingly forming a metal plate, as discussed above, resilient web 600 may be molded from any suitable thermoplastic material, as long as that material possesses resilient properties that make it amenable as a whole to the invention disclosed herein (especially with regard to resilient flexibility).

Like the lateral members disclosed elsewhere herein, lateral members 608 are preferably made from any easily workable material, especially, but not only, wood and various formed wood products. Plastic material reinforced with, for example, glass fiber, is also suitable.

The resilient web of the sixth embodiment, as seen in FIGS. 11–14, is conveniently made using a conventional method of manufacture (e.g., using conventional metal stamping or conventional molding). From an acoustical perspective, a construction member using the resilient web of the sixth embodiment allows linear relative motion between the lateral members, but resists rotational or lateral relative motion.

Although not specifically illustrated herein, resilient web 600 may be provided with one or more spacers as illustrated in, for example, FIGS. 9 and 10, from which comparable benefits are gained. Also, although not specifically illustrated herein, the wall board structure disclosed in commonly owned U.S. patent application Ser. No. 09/260,272 is also desirable for use in connection with a construction member using the resilient web of this sixth embodiment.

As disclosed elsewhere herein, it is beneficial to provide at least one opening in resilient web 600 so as to provide a Helmholtz resonator effect.

It will be appreciated that resilient web 600 may be used with only one lateral member 608, in a manner similar to the arrangement illustrated in FIG. 9. The combination of resilient web 600 and one lateral member 608 can therefore be mounted on a stud in a preexisting wall frame so as to provide retrofit sound attenuation benefits. As with the arrangement in FIG. 9, one or more spacers (similar to spacers 512) may be provided to facilitate arrangement of the web/lateral member combination relative to a stud in the preexisting wall frame.

FIGS. 15*a*–15*d* illustrate a resilient construction member 700 according to a seventh embodiment of the present invention. Construction member 700 is characteristically made from a single material portion that is formed into the requisite shape. Preferably, the single material portion is a metallic material, such as steel, but can also be, for example and without limitation, fiberglass, resin, etc.

Figure 15A:
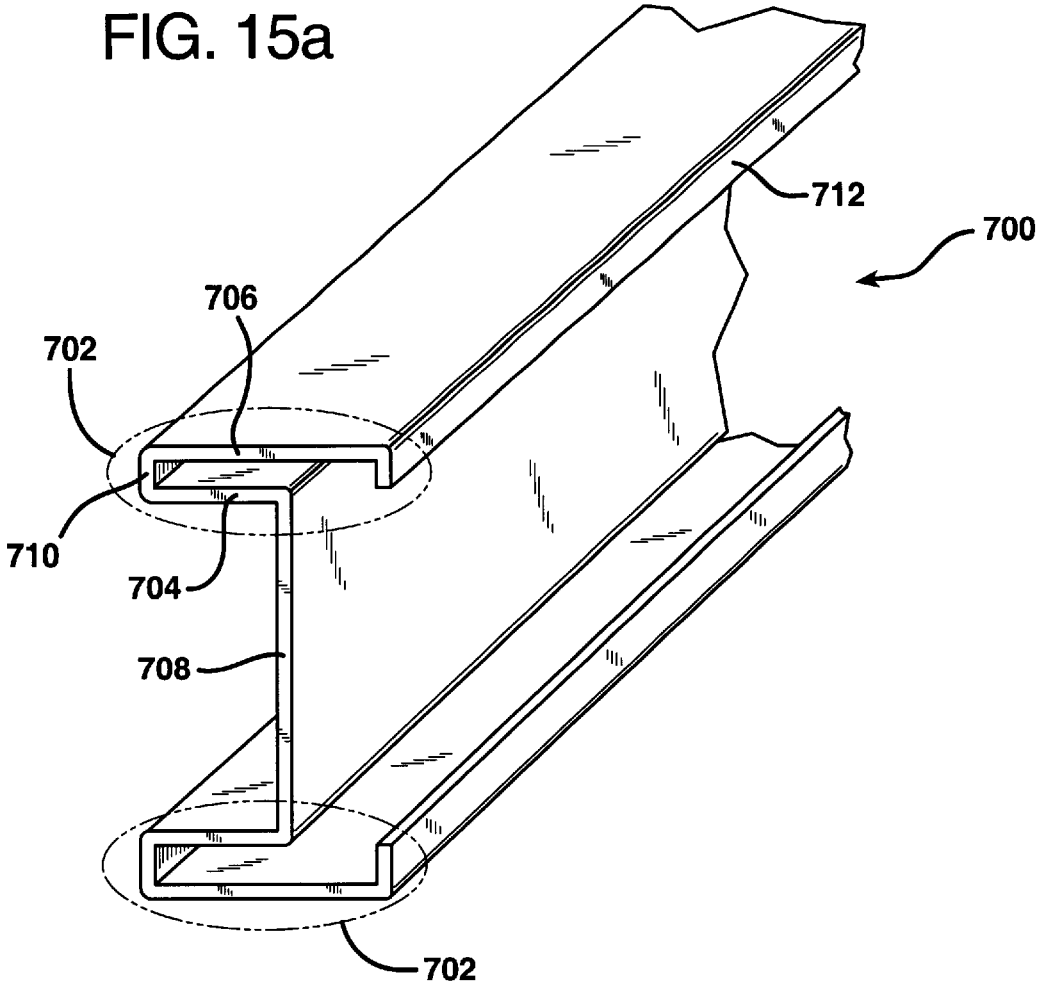
FIG. 15*a* is a partial perspective view of a resilient construction member according to a seventh embodiment of the present invention.

As seen in, for example, FIG. 15*a,* construction member 700 has a beam form. It is:desirable, but not necessary, to provide construction member 700 with width and thickness dimensions that are comparable to conventional beam construction members, such as 2"×4", 2"×6", etc.

Generally, construction member 700 has a form similar to the other embodiments of the present invention. That is, construction member includes, broadly, lateral flange portions 702 with a web 708 extending transversely therebetween. However, as mentioned above, construction member 700 is made from a single material portion, such as steel, that is formed into the requisite beam shape. In the case of metallic materials such as steel, the material can be, for example, bent into shape using convention metal fornming processes. If other materials are used, suitable conventional methods such as molding or extruding can be used.

At least one of the lateral flange portions 702 includes a first subportion 704 extending, most generally, in a first direction skewed relative to the plane of web 708. In the example illustrated in FIGS. 15*a*–15*d,* first subportion 704 extends generally perpendicular to web 708 at, for example, a lateral edge of web 708. Second subportion 706 extends in the opposite direction as first subportion 704, and generally parallel therewith. In this particular example, second subportion 706 is also generally perpendicular to web 708. Second subportion 706 extends beyond the plane of web 708 to an extent generally corresponding to the overall thickness of construction member 700. The first subportion 704 and second subportion 706 may be spaced from each other by a third spacer subportion 710 extending between first subportion 704 and second subportion 706 in a direction, for example, generally parallel with web 708. Finally, second subportion 706 may include a fourth subportion 712 along a distal edge thereof. Fourth subportion 712 may be turned laterally inward (i.e., towards the other flange portion) as illustrated in, for example, FIG. 15*a,* or laterally outward (i.e., away from the other flange portion) as illustrated in, for example, FIG. 16*a.*

Although FIG. 15*a* shows the first and second subportions 704, 706 of the respective flange portions 702 extending in the same directions, the first and second subportions 704, 706 of each flange portion 702 could be provided so as to extend in mirror-reverse directions.

Figure 15B:
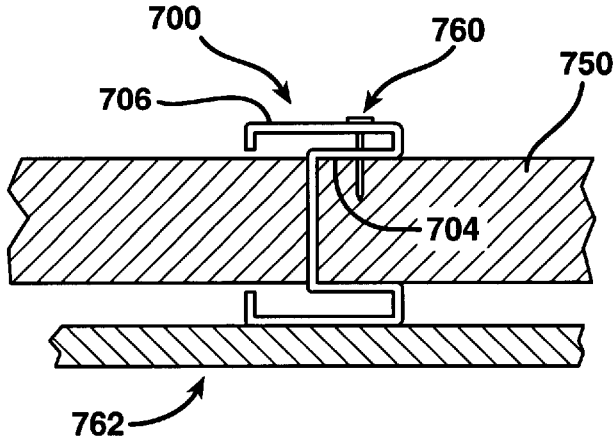
FIG. 15*b* is a cross-sectional view of the resilient construction member according to the seventh embodiment of the present invention in situ.
Figure 15C:
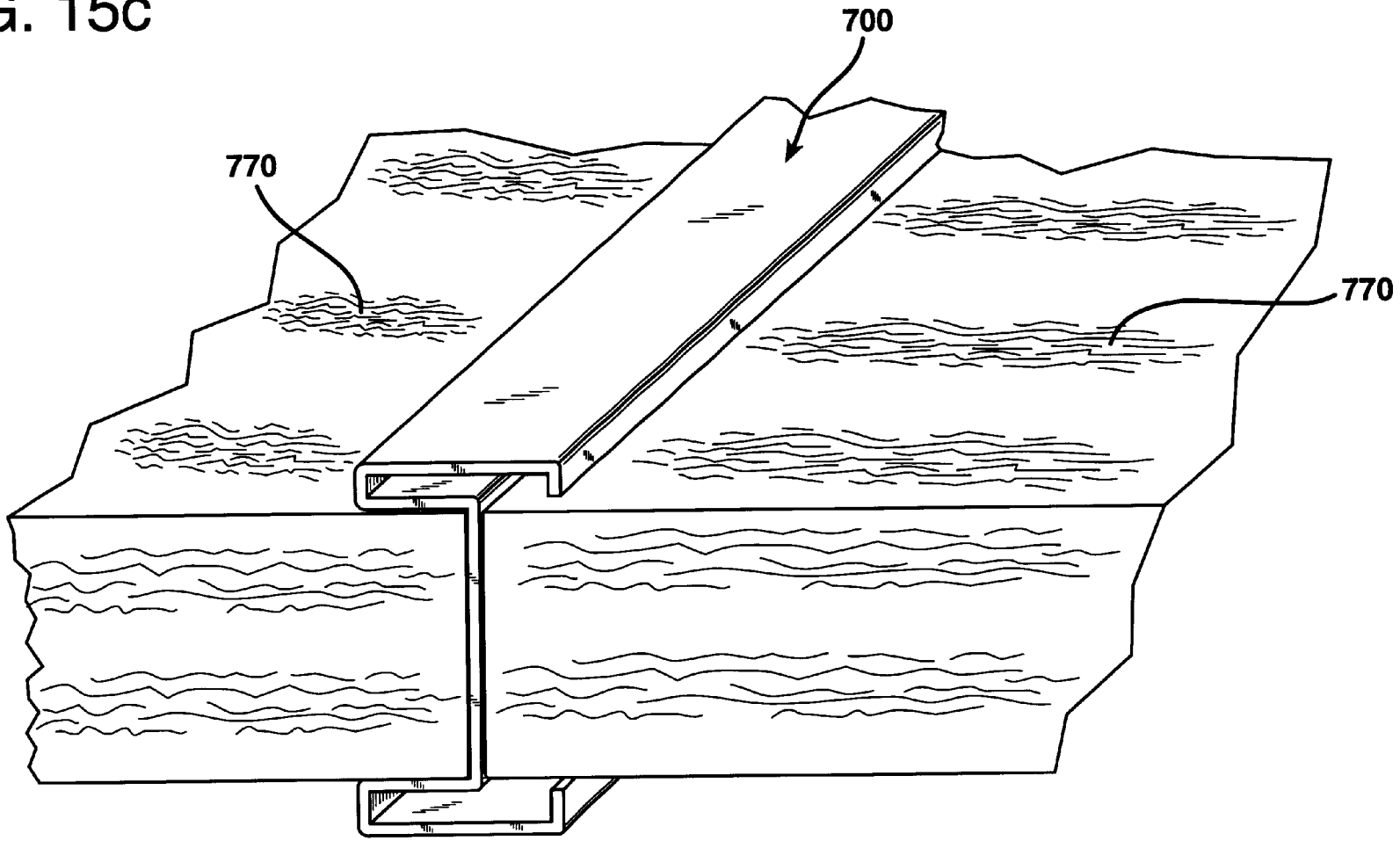
FIG. 15*c* is a partial perspective view of the resilient construction member according to the seventh embodiment of the present invention in situ.
Figure 15D:
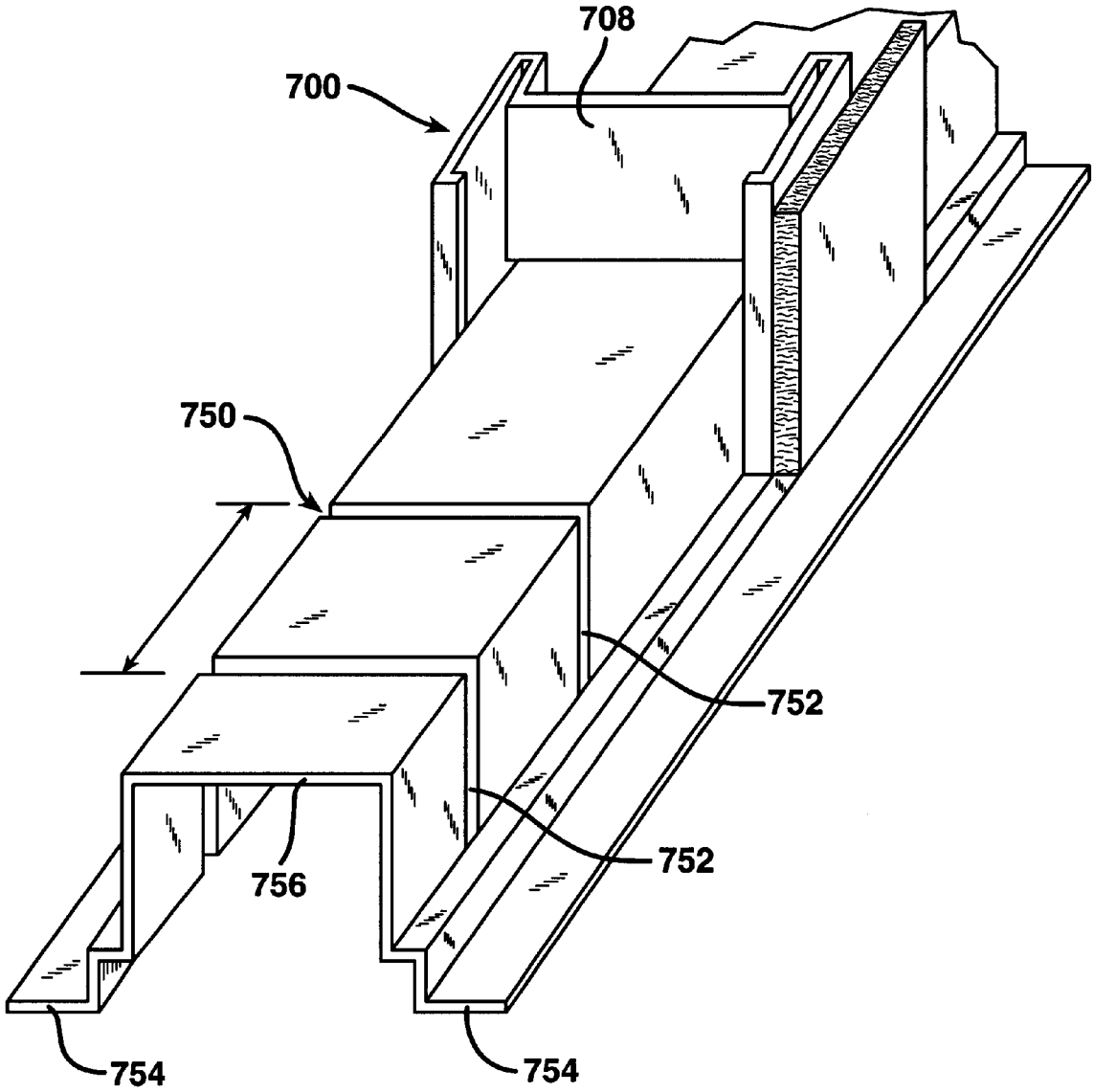
FIG. 15*d* is a partial perspective view of an end plate associated F with a resilient construction member according to the seventh embodiment.

FIGS. 15*b* and 15*d* illustrate the manner in which member 700 can be mounted using an end plate (sometimes known in the art as a footplate) 750. As seen in FIG. 15*d,* an end of member 700 is mounted with respect to end plate 750 by inserting web 708 into one of a plurality of appropriately sized slits 752 formed therein. Specifically, as seen in cross-section, end plate 750 includes first and second base or feet portions 754, and a raised central portion 756 therebetween. Slits 752 are formed in central portion 756 in any desired interval corresponding to a desired spacing between members 700 (for example, 8 inches apart). Preferably, each slit 752 is just wide enough to somewhat snugly receive web 708 therein.

Figure 18:
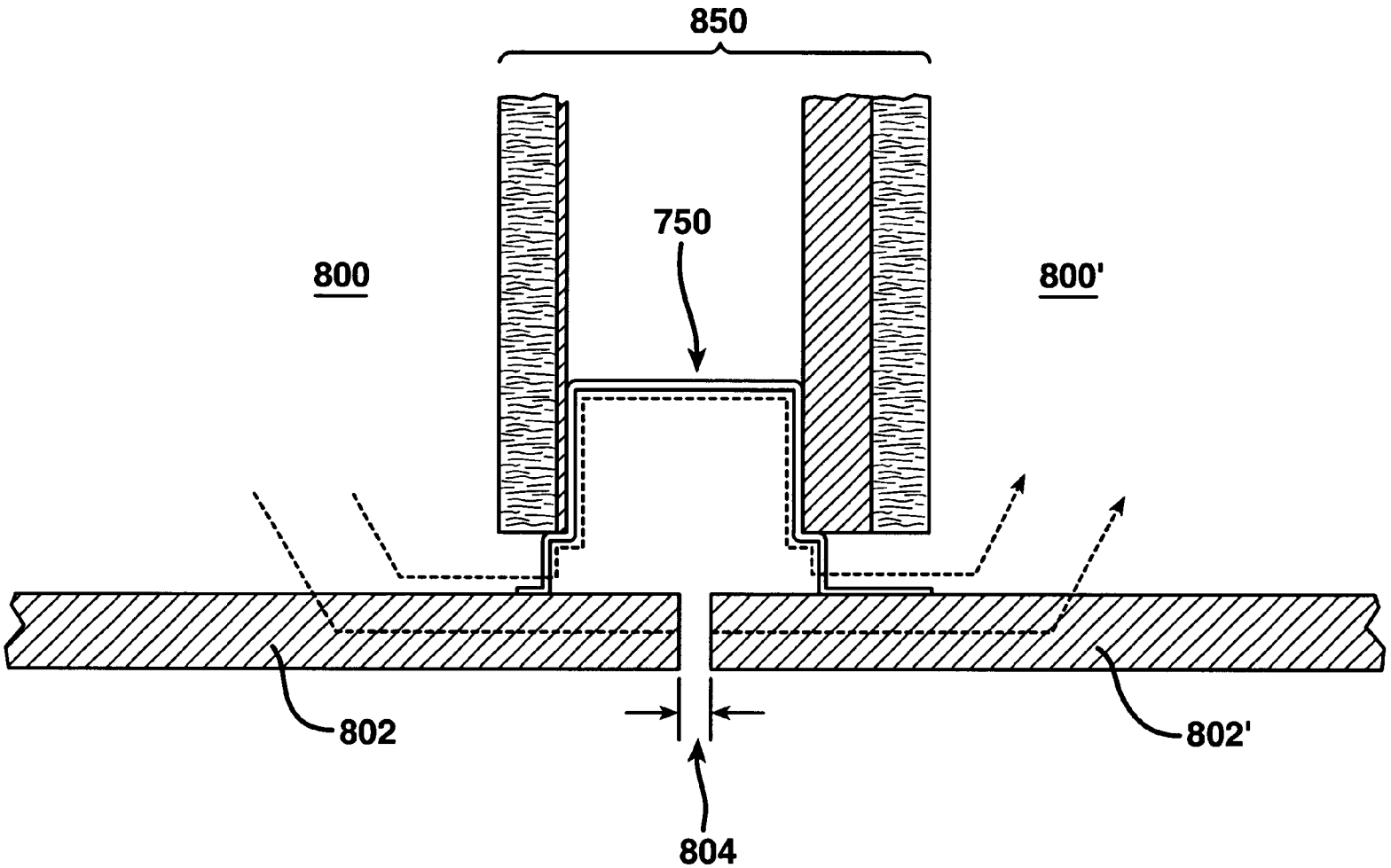
FIG. 18 is a cross-sectional view of an end plate arrangement corresponding to the seventh through ninth embodiments.

The cross-sectional profile of end plate 750 also helps to attenuate sound transmission between rooms, as illustrated in FIG. 18. FIG. 18 illustrates in cross-section a construction between two rooms 800 and 800'. Each room includes floors 802 and 802' and a wall system 850 therebetween. Sound transmission between room 800 and room 800' can be attenuated in part by providing a gap 804 between floors 802 and 802'. This interrupts a sound transmission path (2) that would be available if a contiguous floor were provided.

Figure 19:
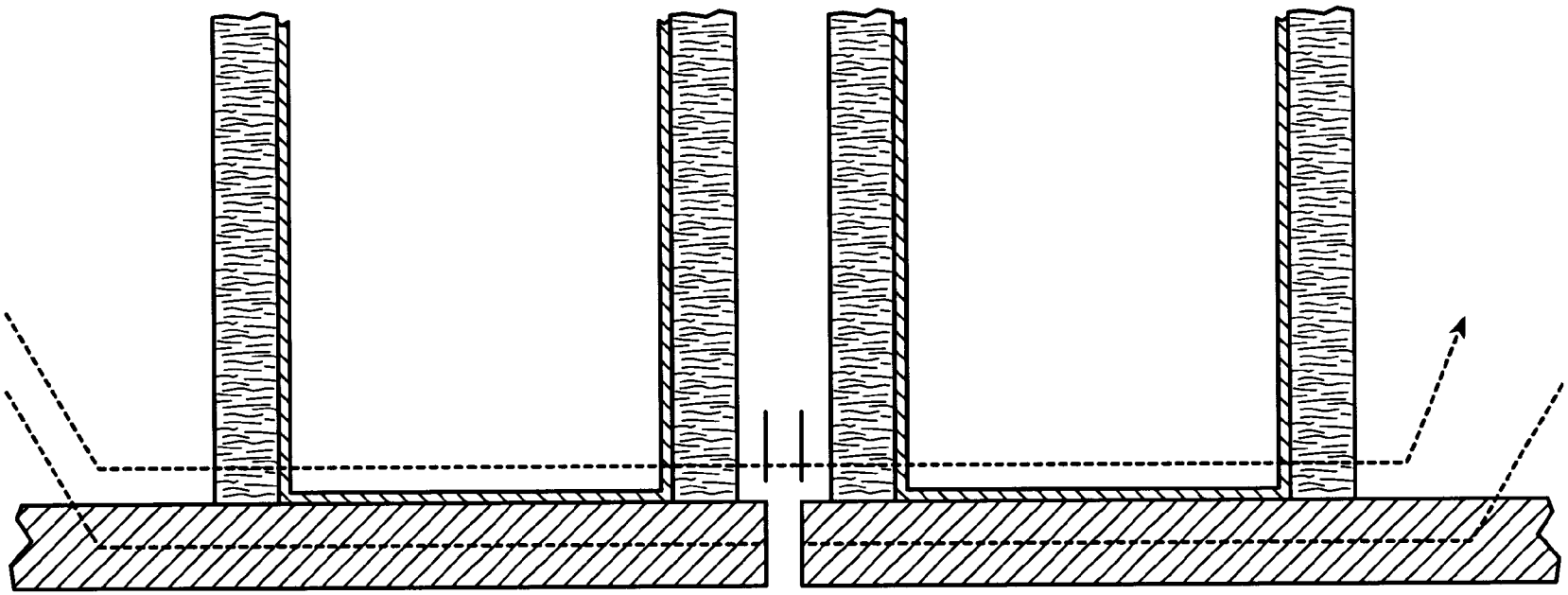
FIG. 19 PRIOR ART
FIG. 19 is a cross-sectional view of a conventional double-wall framing arrangement, e.g., used to effect a physical break between adjacent floor assemblies.

In conventional wall systems as illustrated in FIG. 19, it can be seen that in order to achieve a physical break it would be necessary to utilize a double-wall arrangement. This approach would be expensive and could diminish available dwelling space.

The end plate 750 according to the present invention, however, provides a comparatively much longer transmission path (1) through the cross-sectional periphery of central portion 756, as seen in FIG. 18. This extended transmission path facilitates the dissipation of vibrational energy over its length, and thus, in effect, allows the physical break in the flooring assembly to function as an interruption of sound transmission through the flooring itself. The economic advantage of this approach over the double-wall arrangement would be significant in terms of construction cost & additional available dwelling space.

FIG. 15*b* is a plan view of a member 700 mounted with respect to an end plate 750, similar to the arrangement seen in FIG. 15*d.* Each member 700 may be fixed relative to end plate 750 by any known and suitable method including, without limitation, one or more of fastening members (such as nails, screws, and rivets), welding, and adhesives and the like. As seen in FIG. 15*b,* for example, a fastening member (such as a nail, screw, or rivet) 760 can be driven through first and second subportions 704, 706 into a sidewall of central portion 756.

Also, FIG. 15*b* illustrates a wall member 762 mounted on a second subportion 706 of one of the flange portions of member 700. Such mounting can be accomplished in any known and acceptable manner, including without limitation, fastening members, adhesive, etc. It is particularly desirable, but not necessary, according to the present invention to mount wall member 762 only on second subportion(s) 706 of one or more members 700 so that the wall member 762 is resiliently supported in accordance with principles of the present invention discussed hereinabove.

It will be appreciated that the distance between respective flange portions 702 may be suitable to receive thermal and/or acoustic insulation therebetween. For example, FIG. 15*c* illustrates the use of insulation batts 770 on either side of a member 700.

Figure 16A:
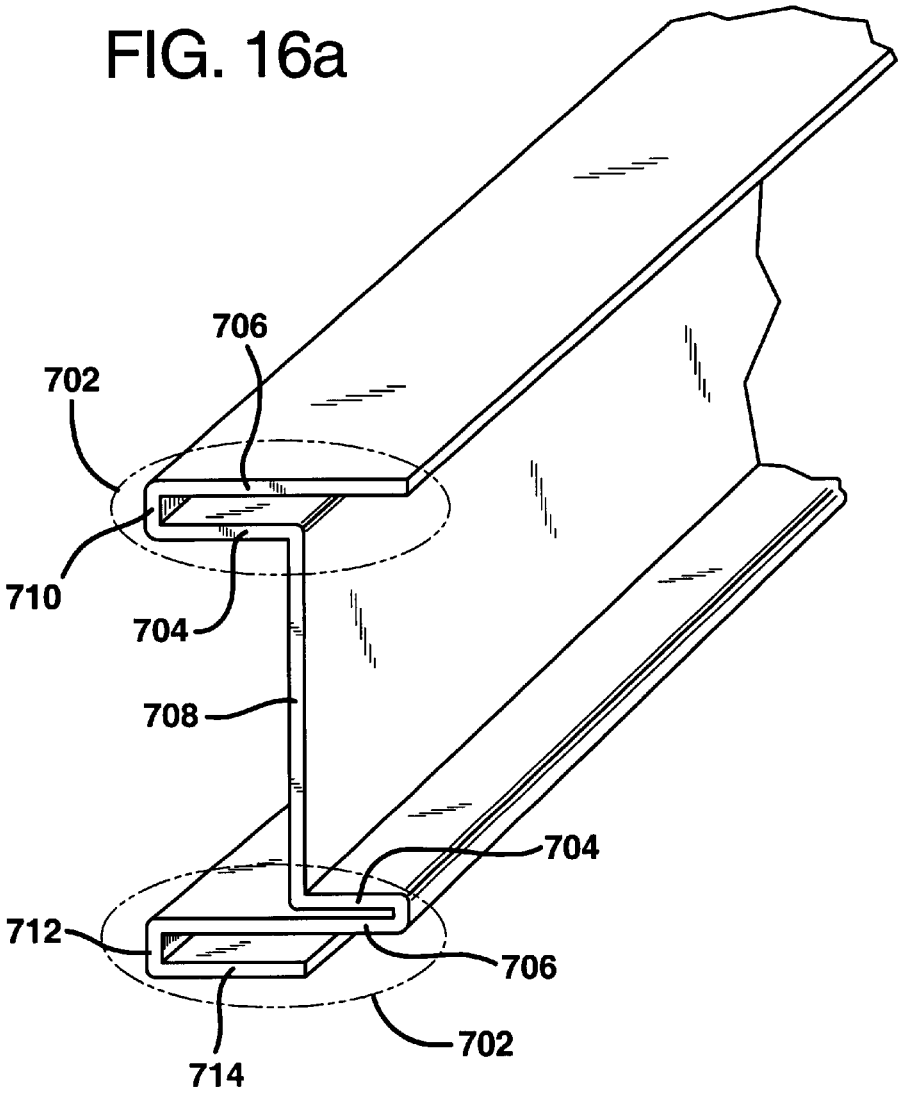
FIG. 16*a* is a partial perspective view of a resilient construction member according to a eighth embodiment of the present invention.
Figure 16B:
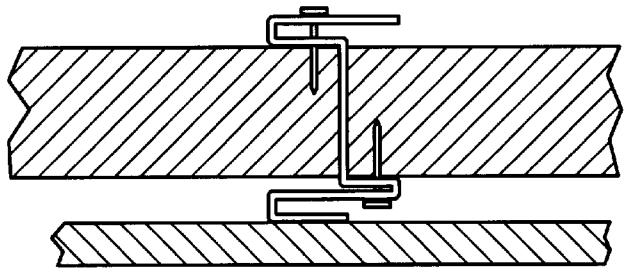
FIG. 16*b* is a cross-sectional view of the resilient construction member according to the eighth embodiment of the present invention in situ.
Figure 16C:
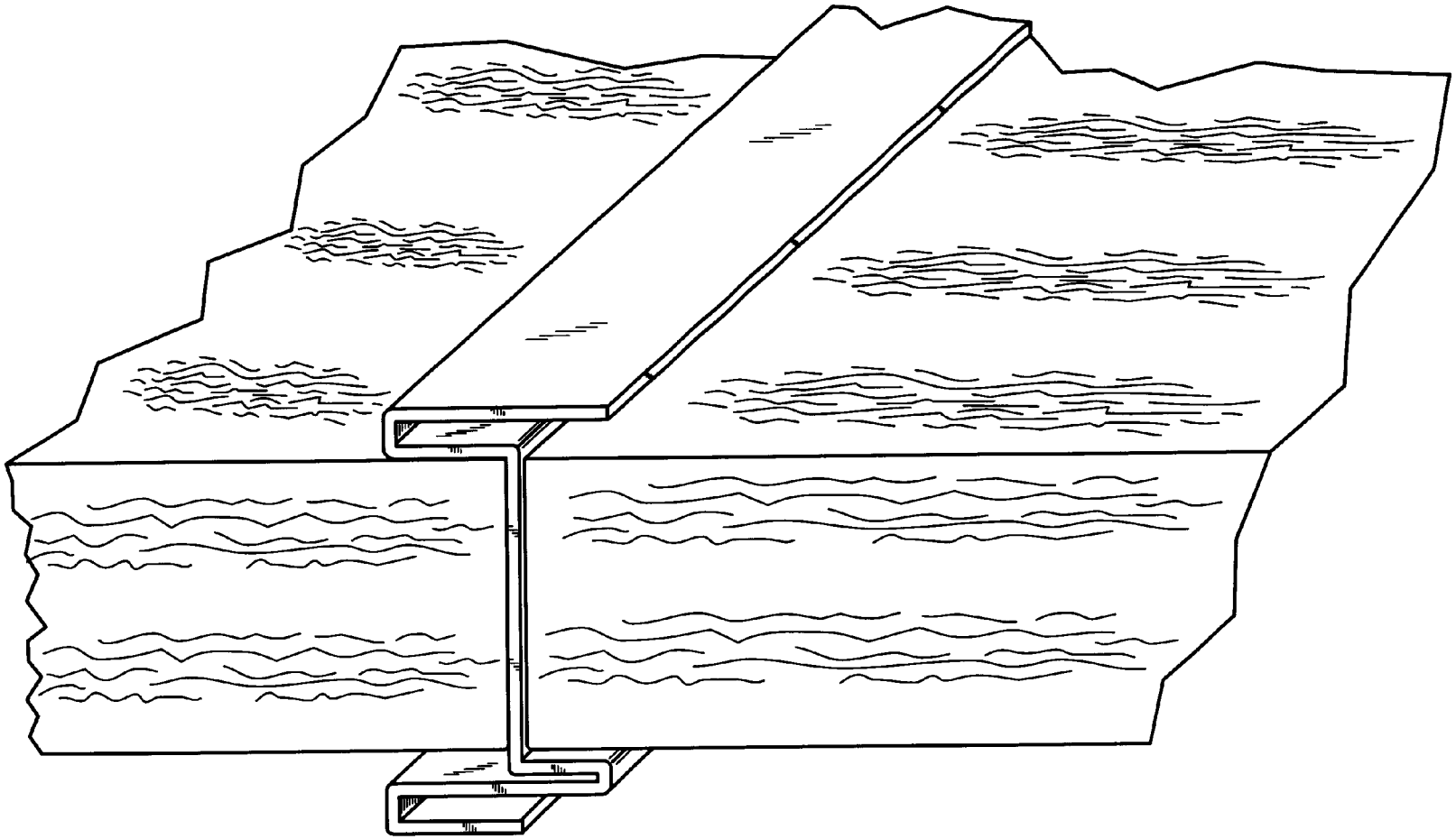
FIG. 16*c* is a partial perspective view of the resilient construction member according to the eighth embodiment of the present invention in situ.
Figure 16D:
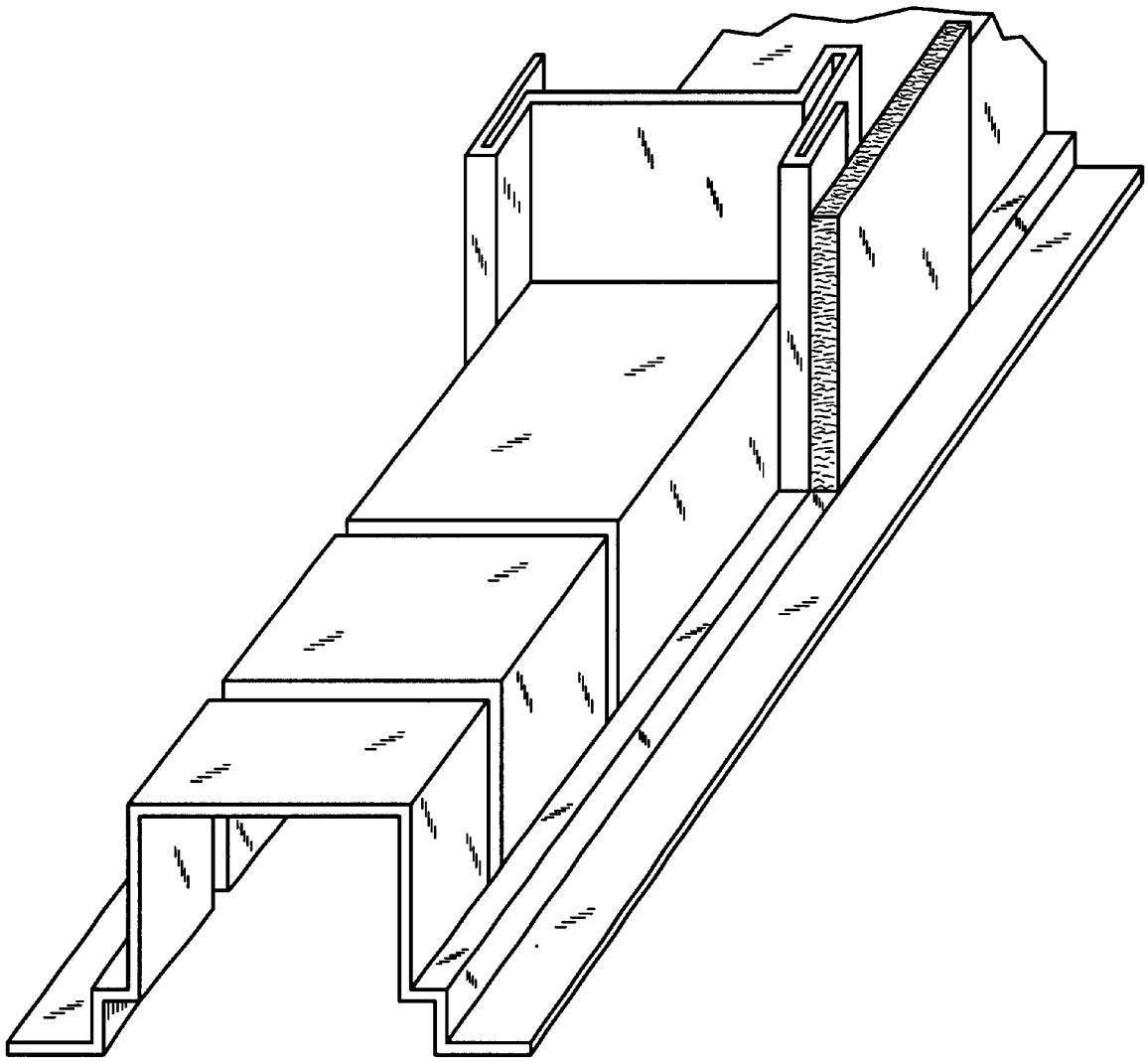
FIG. 16*d* is a partial perspective view of an end plate associated with a resilient construction member according to the eighth embodiment.
Figure 17A:
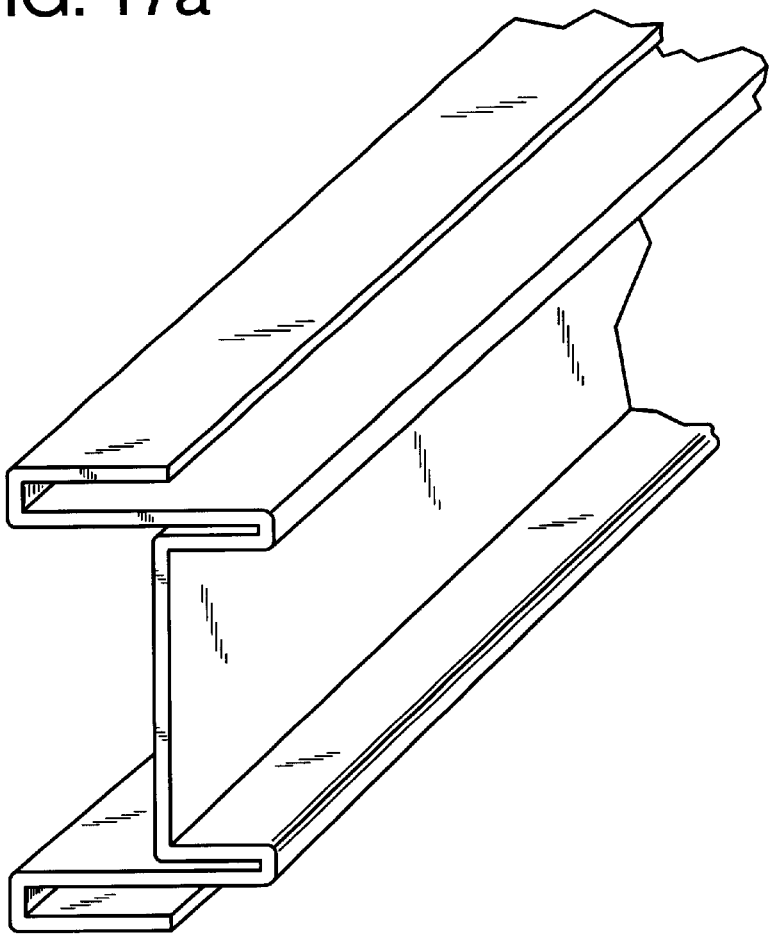
FIG. 17*a* is a partial perspective view of a resilient construction member according to a ninth embodiment of the present invention.
Figure 17B:
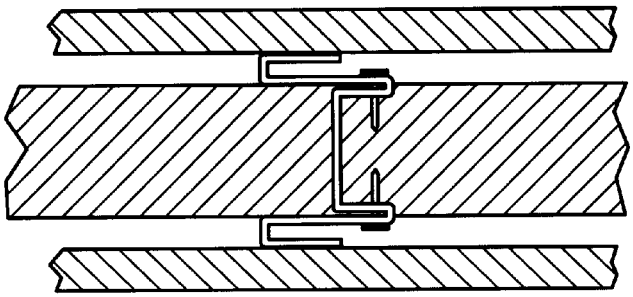
FIG. 17*b* is a cross-sectional view of the resilient construction member according to the ninth embodiment of the present invention in situ.
Figure 17C:
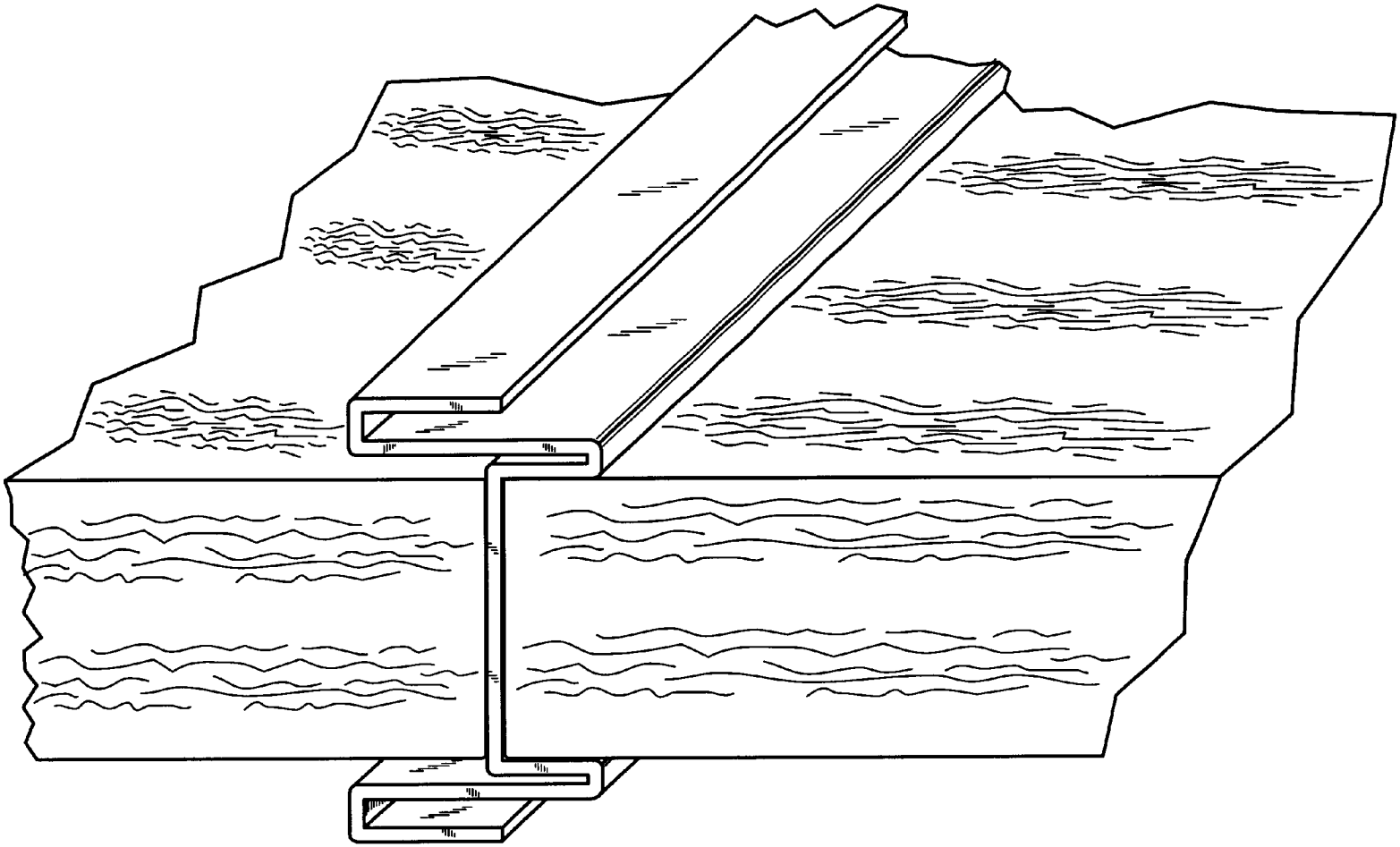
FIG. 17*c* is a partial perspective view of the resilient construction member according to the ninth embodiment of the present invention in situ.
Figure 17D:
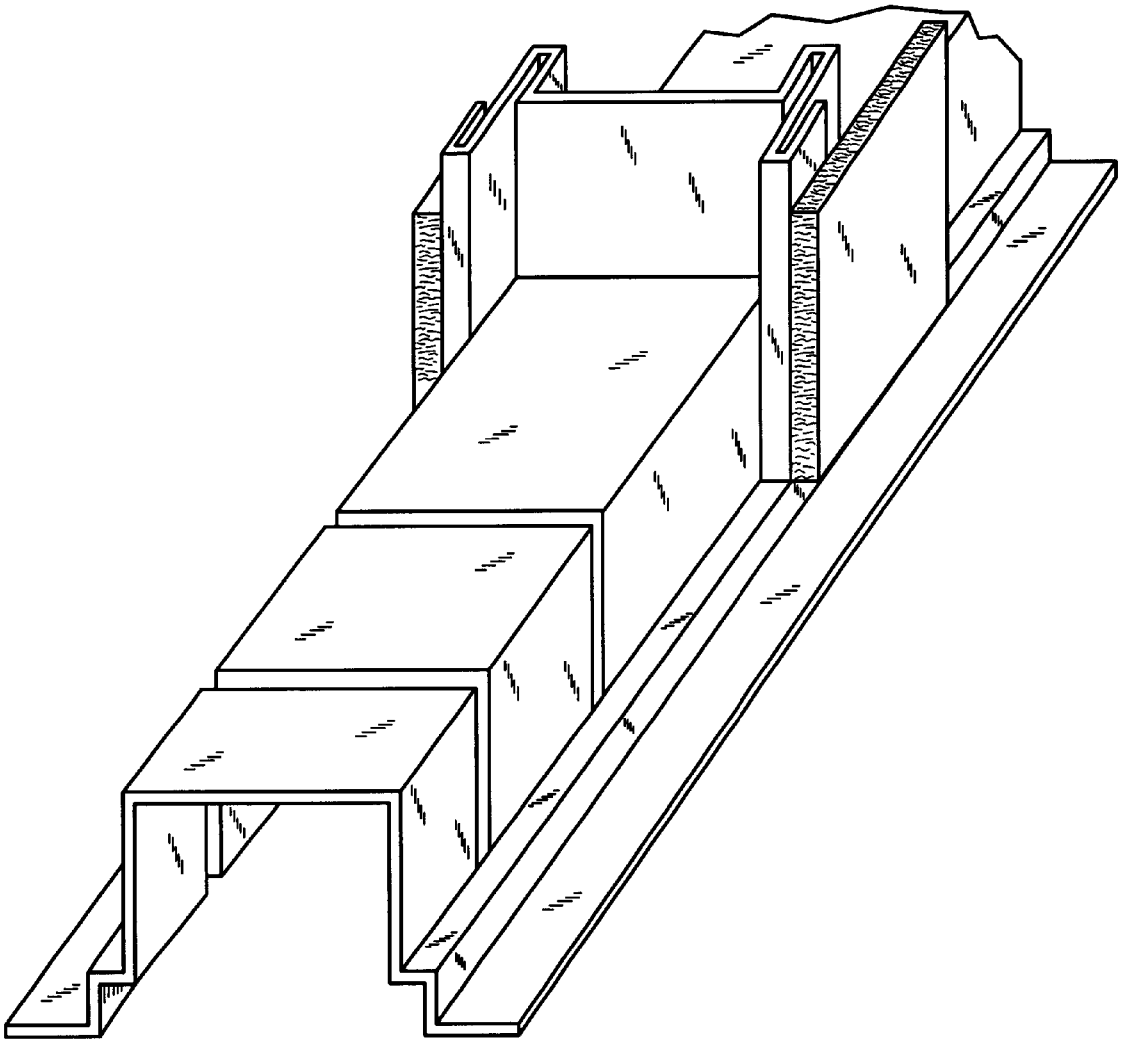
FIG. 17*d* is a partial perspective view of an end plate associated with a resilient construction member according to the ninth embodiment.

FIGS. 16*a*–16*d* and 17*a*–17*d* are substantially similar to the present invention illustrated in FIGS. 15*a*–15*d,* but include construction members having different flange portion configurations. For example, as seen in FIG. 16*a,* one flange portion 702 includes a laterally outward extending fourth subportion 712, as discussed above. Furthermore, a fifth subportion 714 extends from fourth subportion 712. In a particular example of the present invention, fourth subportion 712 is generally parallel with web 708 and perpendicular with fifth subportion 714. The other flange portion 702 in FIG. 16*a* has the same configuration as in FIGS. 15*a*–15*d,* so a repeated explanation of that structure is omitted here.

FIGS. 17*a*–17*d* illustrate a construction member according to the present invention having both flange portions 702 that include a fifth subportion 714. Otherwise, FIGS. 17*a*–17*d* are generally similar to FIGS. 15*a*–15*d* and 16*a*–16*d.*

Figure 20A:
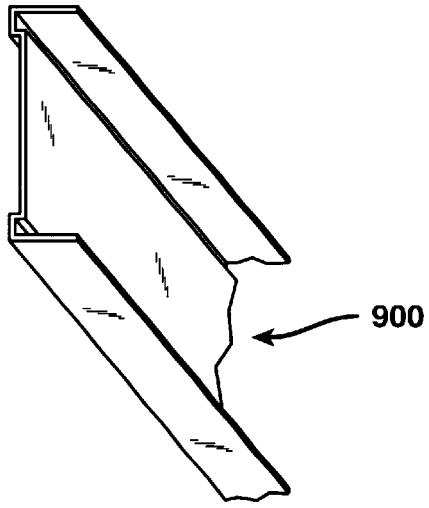
FIGS. 20*a*–20*c* are perspective views of an end plate and two resilient construction members according to tenth and eleventh embodiments of the present invention.
Figure 20B:
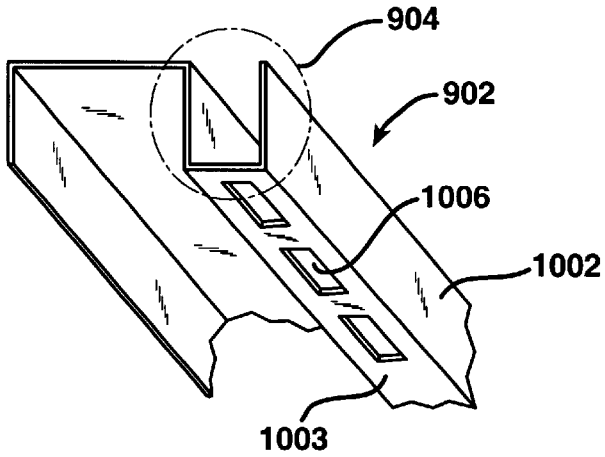
Figure 20C:
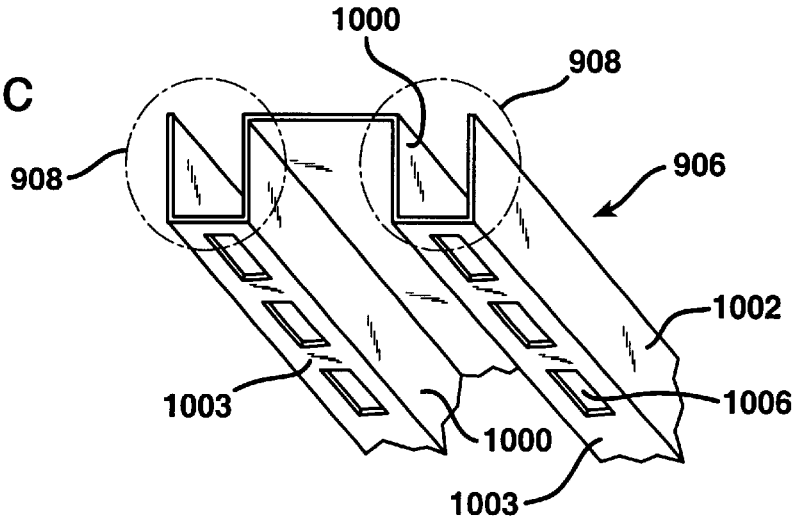

FIGS. 20*a*–20*c* illustrate other embodiments of the present invention which in this case can be seen as an arrangement which more closely resembles that of conventional steel framing in so much that a "U" channel of specific cross section is used as the end plate, to locate and secure the top and bottom of the wall framing arrangement. In particular, FIG. 20*a* illustrates an end plate 900 according to the present invention. FIG. 20*b* illustrates a member 902 having one flange portion 904, while FIG. 20*c* illustrates a member 906 having two flange portions 908. Member 904 can be used for exterior walls, for example, where a floating wall is needed only on one side of a frame system, whereas member 906 can be used in frames located between two rooms that both require sound attenuation such as, for example, music practice rooms, multiplex theaters, etc.

Each flange portion has a structure generally similar to the flange portions 702 of FIG. 15*a,* including a first subportion 1000, a second subportion 1002, and a third subportion 1003. Preferably, third subportion is generally perpendicular to first and second subportions 1000, 1002.

Each flange portion 904, 908 can be provided with one or more openings 1006. Openings 1006 can be sized, in accordance with well-known principles of Helmholtz resonance, to define sound-dissipating Helmholtz resonators between respective members 902 or 906.

Figure 21A:
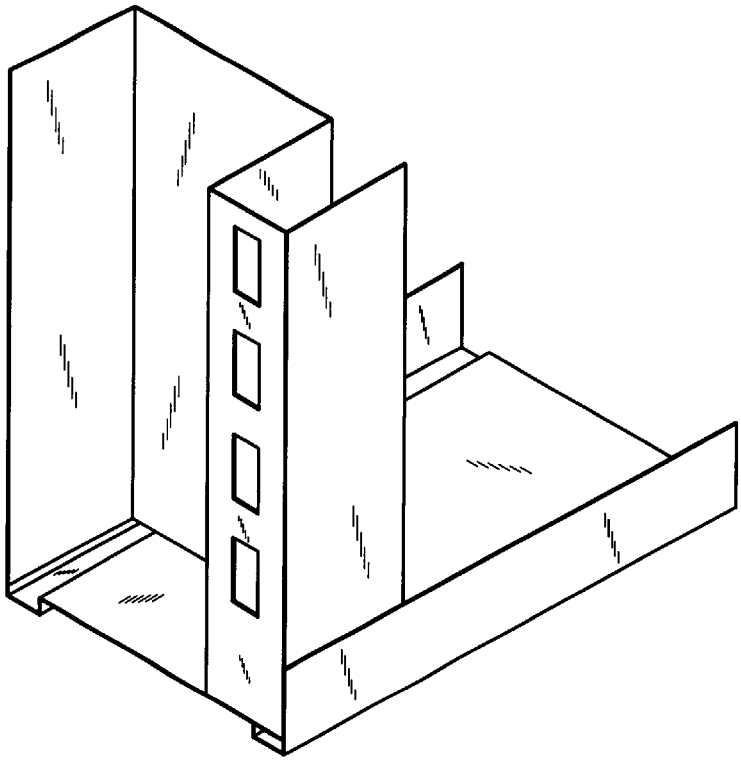
FIGS. 21*a* and 21*b* are perspective views of the resilient construction members of the tenth and eleventh embodiments of the present invention mounted with respect to the end plate shown in FIG. 20*a*.
Figure 21B:
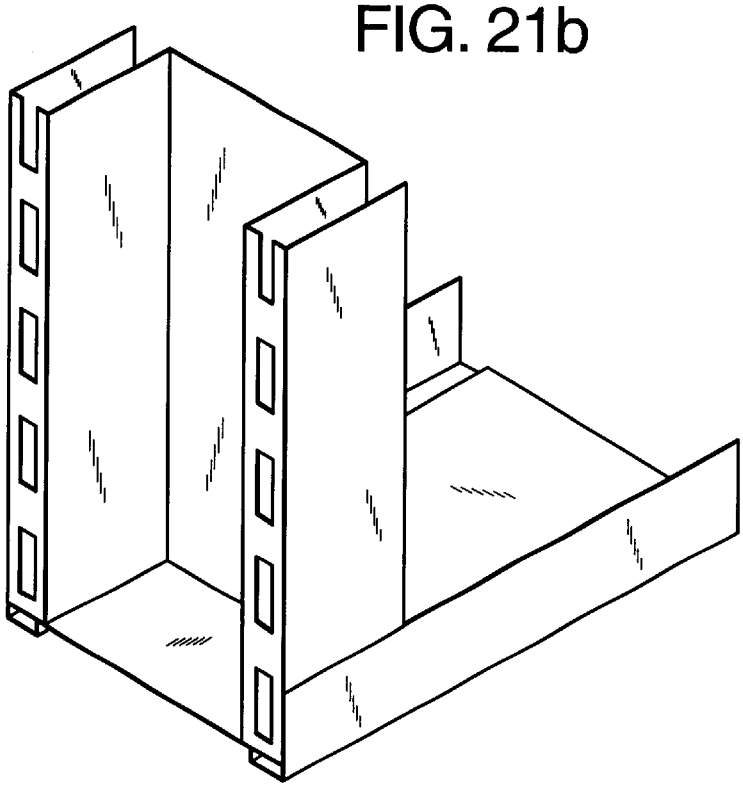

FIGS. 21*a* and 21*b* illustrate how members 902 and 906 can be mounted on end plate 900 in a manner illustrated in FIGS. 21*a,* and 21*b.* An important feature to note in this arrangement is that it is important to use an end plate or "U" channel with clearance in the corners. This would ensure that the flange portions of members 902 and 906 will have the degree of freedom required to allow the entire framing structure to react to impinging sound, that is perform as a resilient structure. Recommended corner clearance would be achieved by providing a recess with a minimum lateral width of ¼ inch, and a minimum depth of 1/16 inch.

The end plate 900 and members 902 and 906 are also preferably made from a single piece of material each, such as bent steel of a desired gauge. Other materials, such as fiberglass, resin, etc. are also usable.

Although construction members according to the present invention have been described hereinabove for wall frames and the like, they are also contemplated for use in mounting floating ceilings which are acoustically isolated from a building structure. In addition, construction members according to the present invention may also be used in floor construction.

In particular, a construction member for mounting a floating ceiling may be used by fixing one of the lateral members (or flange portions) to the building structure and fixing a ceiling member to the free floating lateral member (i.e., the lateral member not fixed to the building structure).

The use of substantially identical lateral members is contemplated according to the present invention. However, use of dissimilar lateral members is also expressly within the scope of the present invention for all embodiments. For example, one of the lateral members 102, 104 shown in FIG. 2 may be replaced by a conventional wood I-beam of the type described above., In particular, web 106 may be embedded in one of the flange portions of the wood I-beam, in the manner disclosed above. Similarly, webs 506 and 600 (as illustrated in FIGS. 9 and 10 and FIGS. 11–14, respectively) are arranged to have end portions on opposite sides of one of the flange portions of the wood I-beam.

Although the present invention is directed primarily to construction members made from non-metal materials, the design concepts may be of interest in the manufacture of metal studs comprising a pair of metal members with a resilient web extending therebetween in accordance with the foregoing description. In particular, a metal stud using the inventive principles disclosed herein could be made from a single piece of sheet metal, formed into shape.

The present invention being thusly described, it will be obvious that the same may be varied in many ways. Such variations are not to be regarded as a departure from the spirit and scope of the invention, and all such modifications as would be obvious to one skilled in the art are intended to be included within the scope of the following claims. It is specifically noted that several embodiments are directed to particular features of the present invention. The manner in which different specific aspects of the present invention can be used in conjunction is discussed to some extent hereinabove. However, the mere fact that one particular feature disclosed herein is not expressly disclosed as being used in conjunction with another particularly disclosed feature is, alone, not meant to be limiting. It should be appreciated that the various embodiments of the present invention are meant to be interrelated such that features from each, to the extent possible, are interchangeable but in keeping with the present invention as contemplated.

What is claimed is:

1. A wall system comprising:

at least one beam member comprising first and second spaced apart and elongate flange portions, and a web extending therebetween, wherein at least one of said first and second spaced apart flange portions comprises at least a first subportion extending from said web in a direction skewed with respect to a plane in which said web lies, and a second subportion extending in a direction from a distal edge of said first subportion back towards said web; and an end plate including, in cross-section, first and second spaced apart feet and a raised central portion extending in a direction opposite to said first and second spaced apart feet, said central portion including at least one slit receiving said web of said at least one beam member therein.

2. The system according to claim 1, wherein said central portion has a lateral width corresponding to a distance between said first and second flange portions of said at least one beam member.

3. The system according to claim 1, comprising a wall member attached to said second subportion of said at least one beam member.

4. The system according to claim 3, wherein said wall member is attached only to said second subportion of said at least one beam member.

5. The system according to claim 3, wherein said at least one beam member is resiliently flexible, such that said wall member is resiliently supported by said at least one beam member.

6. The system according to claim 1, comprising a plurality of said beam members and at least one of acoustic and thermal insulation provided in the spaces between respective said beam members.

* * * * *

UNITED STATES PATENT AND TRADEMARK OFFICE

CERTIFICATE OF CORRECTION

PATENT NO. : 6,615,559 B2
DATED : September 9, 2003
INVENTOR(S) : McGrath

It is certified that error appears in the above-identified patent and that said Letters Patent is hereby corrected as shown below:

Title page,
Item [75], Inventors, three inventors that should be included are:
-- Clarke Berdan II
Frank C. O'Brien-Bernini
Mark H. Smith --

Signed and Sealed this

Twenty-third Day of December, 2003

JAMES E. ROGAN
*Director of the United States Patent and Trademark Office*